US009709907B2

(12) United States Patent
Watariguchi et al.

(10) Patent No.: US 9,709,907 B2
(45) Date of Patent: Jul. 18, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Kaname Watariguchi, Yokohama (JP); Masato Tanaka, Tagata-gun (JP); Masataka Kawahara, Mishima (JP); Jumpei Kuno, Mishima (JP); Tsutomu Nishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/736,824

(22) Filed: Jun. 11, 2015

(65) Prior Publication Data

US 2015/0362848 A1 Dec. 17, 2015

(30) Foreign Application Priority Data

Jun. 13, 2014 (WO) ..... PCT/JP2014/065727

(51) Int. Cl.
*G03G 5/06* (2006.01)

(52) U.S. Cl.
CPC ..... *G03G 5/0638* (2013.01); *G03G 5/0612* (2013.01); *G03G 5/0629* (2013.01); (Continued)

(58) Field of Classification Search
CPC ... G03G 5/0696; G03G 5/0638; G03G 5/0618
See application file for complete search history.

(56) References Cited

U.S. PATENT DOCUMENTS 5,194,088 A * 3/1993 Babler ..... C09B 67/0002 106/31.75
5,310,614 A * 5/1994 Yoshizawa ..... G03G 5/0629 430/58.15

(Continued)

FOREIGN PATENT DOCUMENTS

EP 617091 A2 * 9/1994 ..... C09B 67/0019
JP H05-263007 A 10/1993

(Continued)

OTHER PUBLICATIONS

Diamond, Arthur S (editor) Handbook of Imaging Materials. New York: Marcel-Dekker, Inc. (2002) pp. 145-164.*

*Primary Examiner* — Christopher Rodee
(74) *Attorney, Agent, or Firm* — Canon U.S.A., Inc., IP Division

(57) ABSTRACT

An electrophotographic photosensitive member can provide images in which black spots and fogging are suppressed and density unevenness due to coating unevenness of the charge generation layer is suppressed. The charge generation layer of the electrophotographic photosensitive member contains a gallium phthalocyanine crystal, a nitrogen-containing heterocyclic compound, and an amide compound represented by a formula (1), and a nitrogen atom in a heterocyclic ring of the nitrogen-containing heterocyclic compound has a substituent.

(1)

11 Claims, 8 Drawing Sheets

(52) U.S. Cl.
CPC ..... *G03G 5/0631* (2013.01); *G03G 5/0637* (2013.01); *G03G 5/0642* (2013.01); *G03G 5/0644* (2013.01); *G03G 5/0696* (2013.01)

(56) References Cited

U.S. PATENT DOCUMENTS 5,407,766 A * 4/1995 Mayo ..... G03G 5/0696 430/59.4
5,459,004 A * 10/1995 Daimon ..... G03G 5/0696 430/76
5,834,149 A * 11/1998 Tambo ..... C09B 67/0016 106/413

FOREIGN PATENT DOCUMENTS

| | | | | | |
|---|---|---|---|---|---|
| JP | H05-333572 | A | | 12/1993 | |
| JP | H06-329943 | A | | 11/1994 | |
| JP | H07-331107 | A | | 12/1995 | |
| JP | 11035842 | A | * | 2/1999 | |
| JP | 2001-089481 | A | | 4/2001 | |
| JP | 2002-235014 | A | | 8/2002 | |
| JP | 2005-84350 | A | | 3/2005 | |
| JP | EP 1731575 | A1 | * | 12/2006 | ..... C09B 47/045 |
| JP | 2007-079493 | A | | 3/2007 | |
| JP | 2007-256791 | A | | 10/2007 | |
| JP | WO 2013081178 | A1 | * | 6/2013 | ..... G03G 5/0614 |
| JP | 2014-063180 | A | | 4/2014 | |

* cited by examiner

ELECTROPHOTOGRAPHIC PHOTOSENSITIVE MEMBER, PROCESS CARTRIDGE AND ELECTROPHOTOGRAPHIC APPARATUS

TECHNICAL FIELD

The present invention relates to an electrophotographic photosensitive member and a process cartridge and an electrophotographic apparatus that include an electrophotographic photosensitive member.

BACKGROUND ART

At present, the lasing wavelengths of semiconductor lasers commonly used as image exposure units in the electrophotographic field are long wavelengths of 650 to 820 nm. Accordingly, electrophotographic photosensitive members that have high sensitivity to light of the long wavelengths have been developed. In addition, in order to achieve a higher resolution, electrophotographic photosensitive members that have high sensitivity to light emitted by semiconductor lasers having short lasing wavelengths have been developed recently.

Phthalocyanine pigments are known as charge generation substances that have high sensitivity to light of wavelengths across the long wavelength region to the short wavelength region. In particular, oxytitanium phthalocyanine and gallium phthalocyanine have high sensitivity characteristics and various crystal forms thereof have been reported.

An electrophotographic photosensitive member including a gallium phthalocyanine pigment has high sensitivity characteristics; however, dispersibility of gallium phthalocyanine pigment particles is poor, which is problematic. For this reason, an improvement is necessary to obtain a charge generation layer-coating solution containing this pigment and having high coatability.

In a case where a charge generation layer-coating solution does not have sufficient coatability, during coating, aggregation of pigment particles tends to result in generation of spots (blue spots) or occurrence of coating unevenness in the charge generation layer. Blue spots in a charge generation layer may cause black spots or fogging particularly in output images. On the other hand, coating unevenness in a charge generation layer causes image density unevenness particularly in halftone image formation areas, resulting in degradation of image quality.

Patent Literature 1 states that gallium phthalocyanine and a polyvinylalcohol resin having a specific structure are used to thereby achieve enhancement of coatability and stability of the coating material.

In addition, Patent Literature 2 states that a photosensitive layer contains a nitrogen-containing heterocyclic compound such as morpholine, piperazine, or piperidine to thereby enhance resistance to ozone and resistance to NOx. However, Patent Literature 2 does not describe anything about dispersibility or coatability.

Furthermore, Patent Literature 3 describes a hydroxygallium phthalocyanine crystal obtained by milling treatment using N-methylformamide, N,N-dimethylformamide, N-methylacetamide, and N-methylpropionamide. However, Patent Literature 3 does not describe anything about dispersibility or coatability.

CITATION LIST

Patent Literature

PTL 1: Japanese Patent Laid-Open No. 2005-84350
PTL 2: Japanese Patent Laid-Open No. 5-333572
PTL 3: Japanese Patent Laid-Open No. 2002-235014

As described above, attempts of various improvements in electrophotographic photosensitive members have been made.

However, with the trend of even higher image quality in recent years, there has been a demand for output images of high quality having no black spots or fogging and having no density unevenness.

An object of the present invention is to provide an electrophotographic photosensitive member that can provide images in which black spots and fogging are suppressed and density unevenness due to coating unevenness in the charge generation layer is suppressed.

Other objects of the present invention are to provide an electrophotographic apparatus and a process cartridge that include the electrophotographic photosensitive member.

SUMMARY OF INVENTION

Aspects of the present invention provide an electrophotographic photosensitive member including a support, a charge generation layer formed on the support, and a charge transport layer formed on the charge generation layer. The charge generation layer contains a gallium phthalocyanine crystal, a nitrogen-containing heterocyclic compound, and an amide compound represented by a formula (1) below,

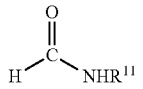

(1)

in the formula (1), $R^{11}$ represents a methyl group or a propyl group. A nitrogen atom in a heterocyclic ring of the nitrogen-containing heterocyclic compound has a substituent. The substituent of the nitrogen atom having a substituent is a substituted or unsubstituted acyl group, —(C═O)—O—$R^1$, a substituted or unsubstituted alkyl group, a substituted or unsubstituted alkenyl group, a substituted or unsubstituted aryl group, or a substituted or unsubstituted heterocyclic group. A substituent of the substituted acyl group is a group described in (i), and $R^1$ represents a group described in (ii):

(i) a substituted or unsubstituted alkyl group, a substituted or unsubstituted alkenyl group, a substituted or unsubstituted aryl group, or a substituted or unsubstituted heterocyclic group, where, in this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group, (ii) a substituted or unsubstituted alkyl group, a substituted or unsubstituted alkenyl group, a substituted or unsubstituted aryl group, or a substituted or unsubstituted heterocyclic group where, in this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

Aspects of the present invention also provide a process cartridge supporting, as integrated units, the electrophotographic photosensitive member, and at least one unit selected from the group consisting of a charging unit, a development unit, and a cleaning unit, wherein the process cartridge is detachably mountable on a body of an electrophotographic apparatus.

Aspects of the present invention also provide an electrophotographic apparatus including the electrophotographic photosensitive member, a charging unit, an exposure unit, a development unit, and a transfer unit.

Further features of the present invention will become apparent from the following description of exemplary embodiments with reference to the attached drawings.

DESCRIPTION OF EMBODIMENTS

Figure 1:
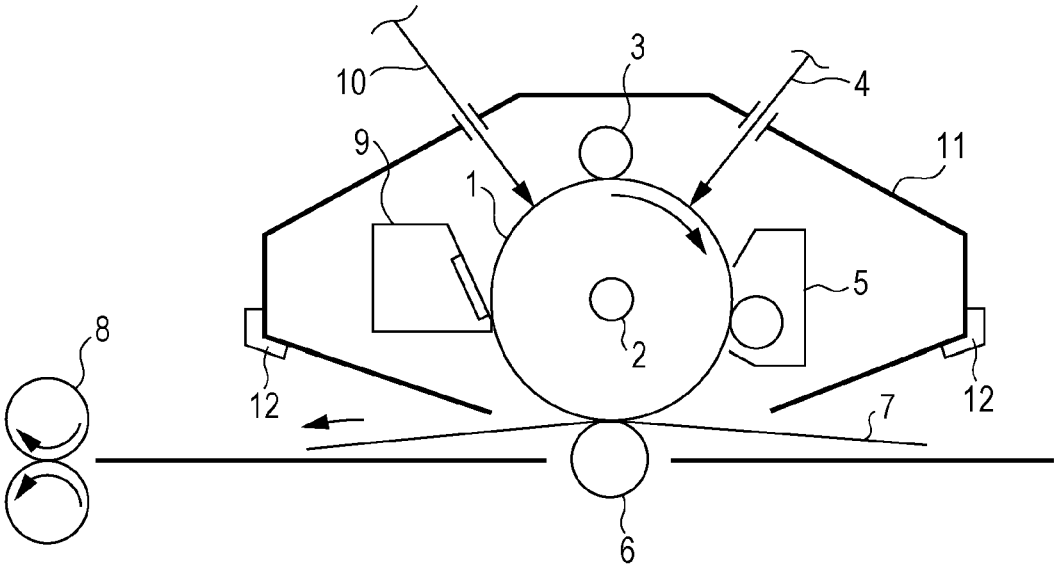
FIG. 1 illustrates an example of the schematic configuration of an electrophotographic apparatus including a process cartridge including an electrophotographic photosensitive member.

An electrophotographic photosensitive member according to the present invention includes a support, a charge generation layer formed on the support, and a charge transport layer formed on the charge generation layer. The charge generation layer contains a gallium phthalocyanine crystal, a nitrogen-containing heterocyclic compound, and an amide compound represented by a formula (1) below.

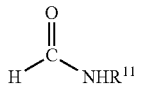

(1)

(in the formula (1), $R^{11}$ represents a methyl group or a propyl group.)

A nitrogen atom in a heterocyclic ring of the nitrogen-containing heterocyclic compound has a substituent. The substituent of the nitrogen atom having a substituent is a substituted or unsubstituted acyl group, —(C═O)—O—$R^1$, a substituted or unsubstituted alkyl group, a substituted or unsubstituted alkenyl group, a substituted or unsubstituted aryl group, or a substituted or unsubstituted heterocyclic group.

A substituent of the substituted acyl group is a group described in (i) below. $R^1$ represents a group described in (ii) below.

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

The above-described features allow suppression of black spots and fogging and suppression of density unevenness due to coating unevenness in the charge generation layer. This is probably achieved for the following reason.

The compounds represented by the formula (1) have high polarity and the carbonyl group has an electron attracting effect. Thus, the compounds probably tend to withdraw electrons from a molecule of gallium phthalocyanine crystal. This probably facilitates the flow of electrons from gallium phthalocyanine crystal. In addition, a nitrogen atom of the nitrogen-containing heterocyclic compound has a substituent and hence has properties of a tertiary amine in which bondability to hydrogens is suppressed. This probably further facilitates the flow of electrons in the relationship between gallium phthalocyanine crystal and compound represented by the formula (1). In addition, dispersibility of gallium phthalocyanine crystal is enhanced and local charge injection and coating unevenness are suppressed, which probably results in suppression of black spots, fogging, and density unevenness.

The nitrogen-containing heterocyclic compound is preferably pyrrole, pyrrolidine, morpholine, piperazine, piperidine, 4-piperidone, indole, imidazole, phenothiazine, phenoxazine, or carbazole. Of these, more preferred are morpholine, piperazine, piperidine, 4-piperidone, indole, and imidazole.

A substituent of a non-nitrogen atom (for example, a carbon atom) of a ring in the nitrogen-containing heterocyclic compound is preferably as follows: a substituted or unsubstituted alkyl group, a substituted or unsubstituted aryl group, a substituted or unsubstituted heterocyclic group, a halogen atom, a hydroxy group, a formyl group, an alkenyl group, an alkoxy group, or an alkyloxycarbonyl group.

In this case, more preferably, a substituent of the substituted alkyl group, a substituent of the substituted aryl group, and a substituent of the substituted heterocyclic group are each a halogen atom, a hydroxy group, or a formyl group.

From the standpoint of the effect of suppressing black spots, fogging, and coating unevenness in a charge generation layer, particularly preferred nitrogen-containing heterocyclic compounds are compounds represented by formulae (2) to (7) below.

(2)

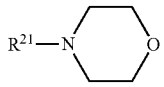

In the formula (2), $R^{21}$ represents a substituted or unsubstituted acyl group, —(C═O)—O—$R^2$, a substituted or unsubstituted alkyl group, a substituted or unsubstituted alkenyl group, a substituted or unsubstituted aryl group, or a substituted or unsubstituted heterocyclic group. A substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

A substituent of the substituted acyl group is a group described in (i) below. $R^2$ represents a group described in (ii) below.

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(3)

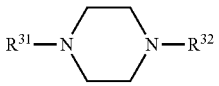

In the formula (3), $R^{31}$ and $R^{32}$ each independently represent a substituted or unsubstituted acyl group, —(C═O)—O—$R^3$, a substituted or unsubstituted alkyl group, a substituted or unsubstituted alkenyl group, a substituted or unsubstituted aryl group, or a substituted or unsubstituted heterocyclic group. A substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

A substituent of the substituted acyl group is a group described in (i) below. $R^3$ represents a group described in (ii) below.)

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(4)

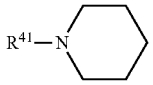

In the formula (4), $R^{41}$ represents a substituted or unsubstituted acyl group, —(C═O)—O—$R^4$, a substituted or unsubstituted alkyl group, a substituted or unsubstituted alkenyl group, a substituted or unsubstituted aryl group, or a substituted or unsubstituted heterocyclic group. A substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

A substituent of the substituted acyl group is a group described in (i) below. $R^4$ represents a group described in (ii) below.)

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(5)

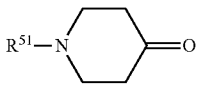

In the formula (5), $R^{51}$ represents a substituted or unsubstituted acyl group, —(C═O)—O—$R^5$, a substituted or unsubstituted alkyl group, a substituted or unsubstituted alkenyl group, a substituted or unsubstituted aryl group, or a substituted or unsubstituted heterocyclic group. A substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

A substituent of the substituted acyl group is a group described in (i) below. $R^5$ represents a group described in (ii) below.

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(6)

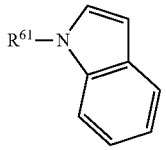

In the formula (6), $R^{61}$ represents a substituted or unsubstituted acyl group, —(C═O)—O—$R^6$, a substituted or unsubstituted alkyl group, a substituted or unsubstituted alkenyl group, a substituted or unsubstituted aryl group, or a substituted or unsubstituted heterocyclic group. A substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

A substituent of the substituted acyl group is a group described in (i) below. $R^6$ represents a group described in (ii) below.)

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(7)

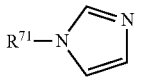

In the formula (7), $R^{71}$ represents a substituted or unsubstituted acyl group, —(C═O)—O—$R^7$, a substituted or unsubstituted alkyl group, a substituted or unsubstituted alkenyl group, a substituted or unsubstituted aryl group, or a substituted or unsubstituted heterocyclic group. A substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

A substituent of the substituted acyl group is a group described in (i) below. $R^7$ represents a group described in (ii) below.

(i) A substituted or unsubstituted alkyl group, a substituted or unsubstituted alkenyl group, a substituted or unsubstituted aryl group, or a substituted or unsubstituted heterocyclic group. In this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

(ii) A substituted or unsubstituted alkyl group, a substituted or unsubstituted alkenyl group, a substituted or unsubstituted aryl group, or a substituted or unsubstituted heterocyclic group. In this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

In the formulae (2) to (7), $R^{21}$, $R^{31}$, $R^{32}$, $R^{41}$, $R^{51}$, $R^{61}$, and $R^{71}$ each independently preferably represent a methyl group, an ethyl group, or a phenyl group.

The content of the nitrogen-containing heterocyclic compound in the charge generation layer relative to the gallium phthalocyanine crystal is preferably 0.01% by mass or more and 20% by mass or less, more preferably 0.1% by mass or more and 5% by mass or less. The nitrogen-containing heterocyclic compound may be an amorphous compound or a crystalline compound. Two or more nitrogen-containing heterocyclic compounds may be used in combination.

The gallium phthalocyanine crystal is preferably a gallium phthalocyanine crystal in which the nitrogen-containing heterocyclic compound is contained. In this case, the content of the nitrogen-containing heterocyclic compound within the gallium phthalocyanine crystal relative to the gallium phthalocyanine crystal is preferably 0.01% by mass or more and 2% by mass or less.

The following are preferred specific examples (example compounds) of the nitrogen-containing heterocyclic compound contained in an electrophotographic photosensitive member according to the present invention. However, the present invention is not limited to these examples.

(A1)

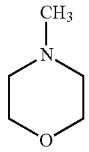

(A2)

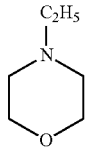

(A3)

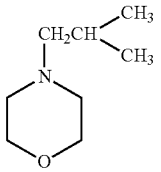

(A4)

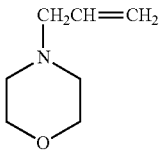

(A5)

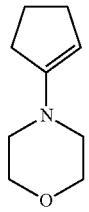

(A6)

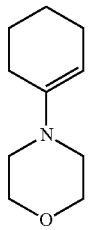

(A7)

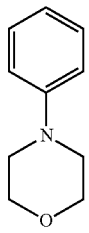

-continued (A8)

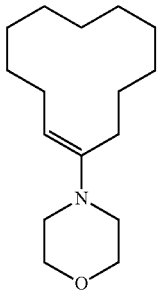

(A9)

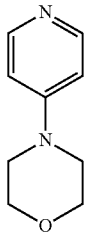

(A10)

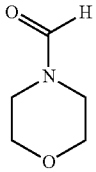

(A11)

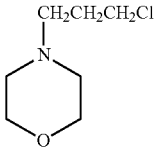

(A12)

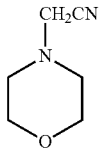

(A13)

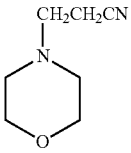

(A14)

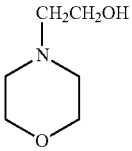

(A15)

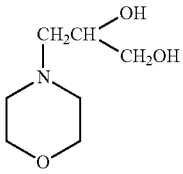

-continued
(A16)
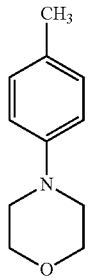
(A17)
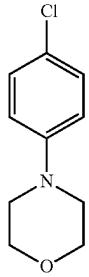
(A18)
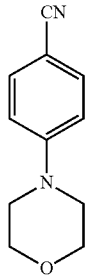
(A19)
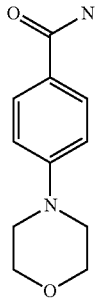
(A20)
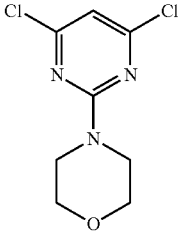
(A21)
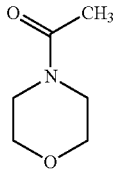
-continued
(A22)
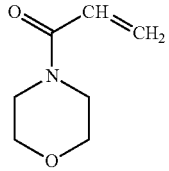
(A23)
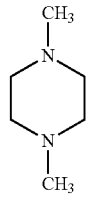
(A24)
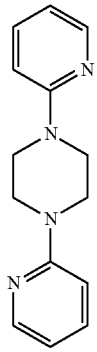
(A25)
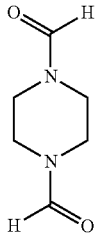
(A26)
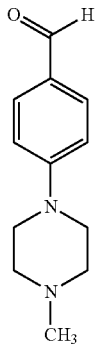

-continued
(A27)
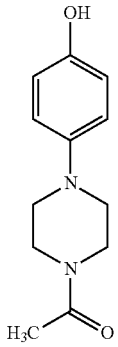
(A28)
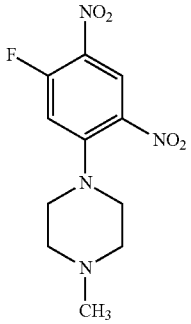
(A29)
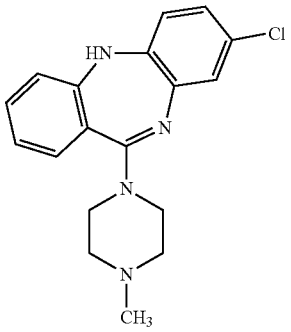
(A30)
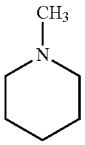
(A31)
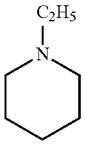
(A32)
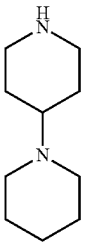
-continued
(A33)
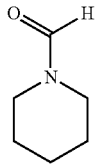
(A34)
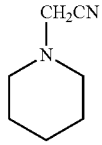
(A35)
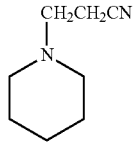
(A36)
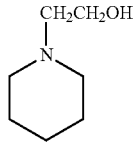
(A37)
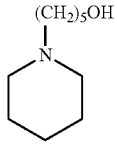
(A38)
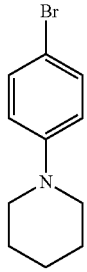
(A39)
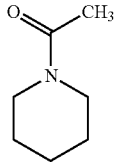
(A40)
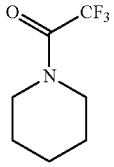
(A41)
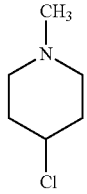

-continued
(A42)
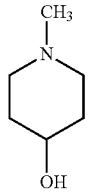
(A43)
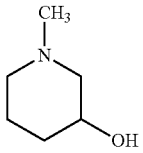
(A44)
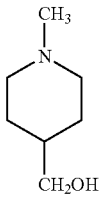
(A45)
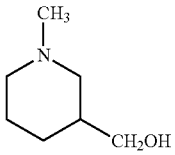
(A46)
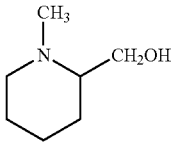
(A47)
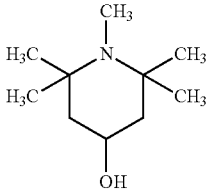
(A48)
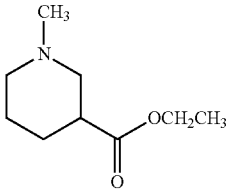
(A49)
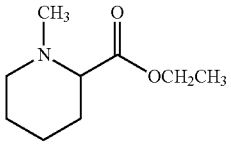
(A50)
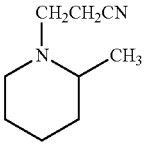
-continued
(A51)
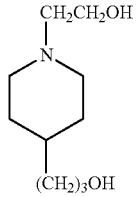
(A52)
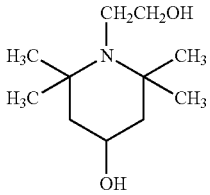
(A53)
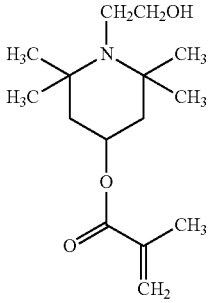
(A54)
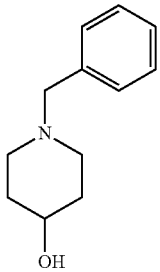
(A55)
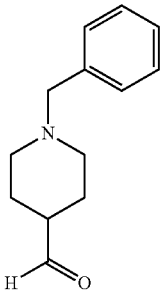
(A56)
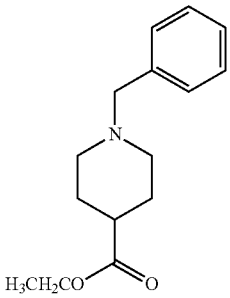

-continued
(A57)
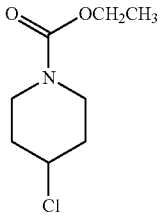
(A58)
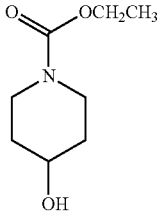
(A59)
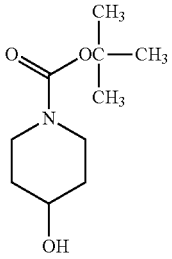
(A60)
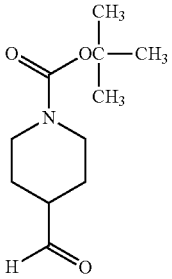
(A61)
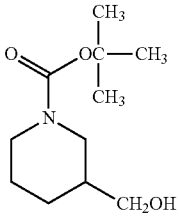
(A62)
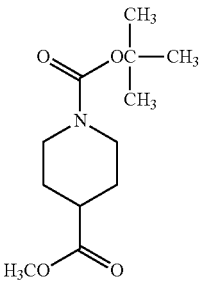
-continued
(A63)
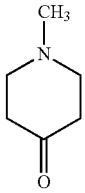
(A64)
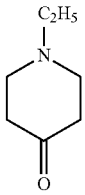
(A65)
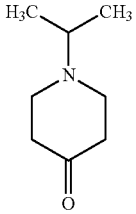
(A66)
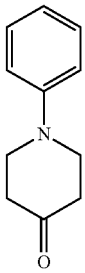
(A67)
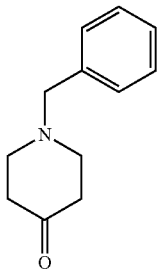
(A68)
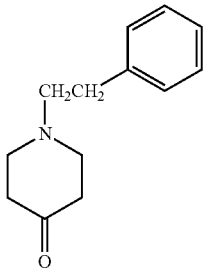

-continued
(A69)
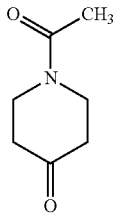
(A70)
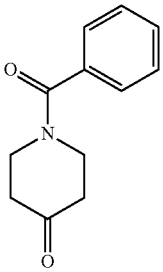
(A71)
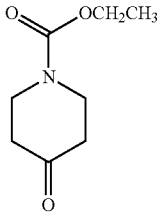
(A72)
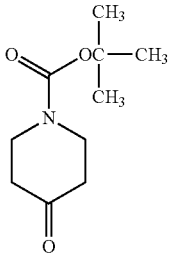
(A73)
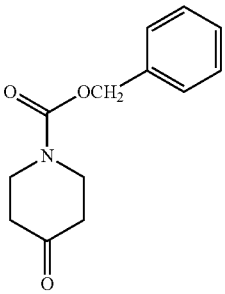
(A74)
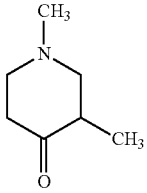
-continued
(A75)
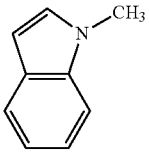
(A76)
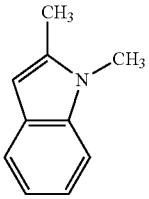
(A77)
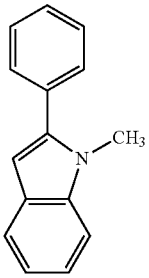
(A78)
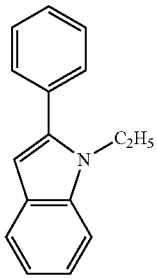
(A79)
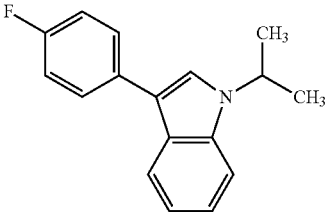
(A80)
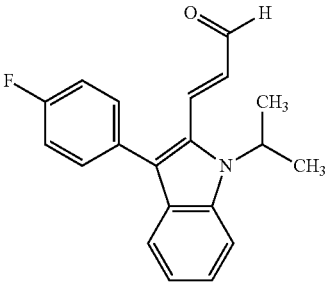
(A81)
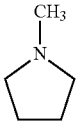

-continued
(A82)
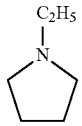
(A83)
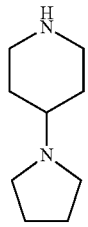
(A84)
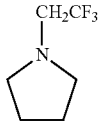
(A85)
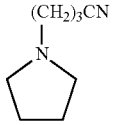
(A86)
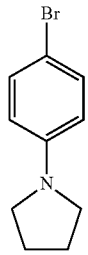
(A87)
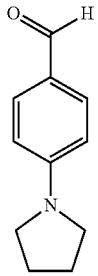
(A88)
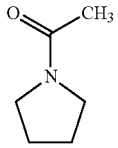
(A89)
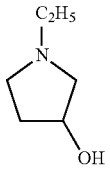
-continued
(A90)
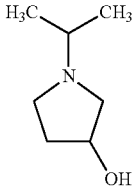
(A91)
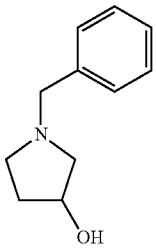
(A92)
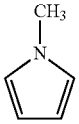
(A93)
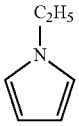
(A94)
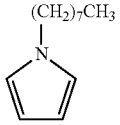
(A95)
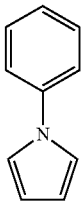
(A96)
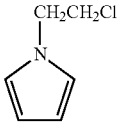
(A97)
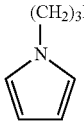
(A98)
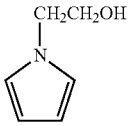

-continued
(A99)
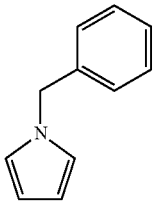
(A100)
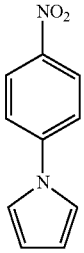
(A101)
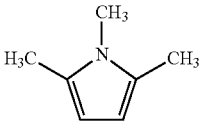
(A102)
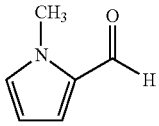
(A103)
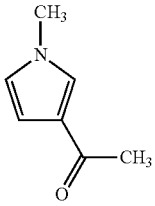
(A104)
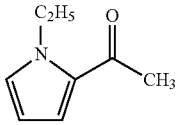
(A105)
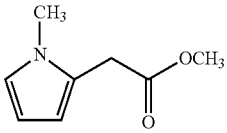
(A106)
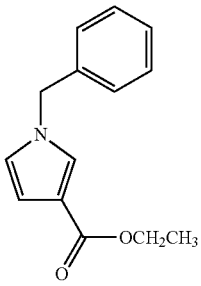
-continued
(A107)
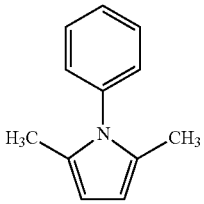
(A108)
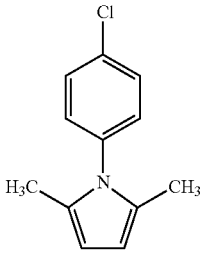
(A109)
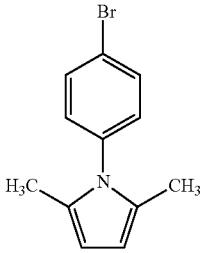
(A110)
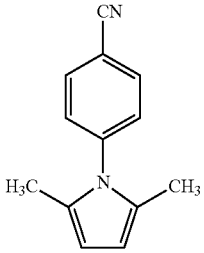
(A111)
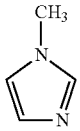
(A112)
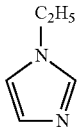
(A113)
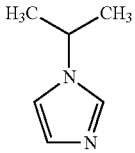
(A114)
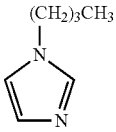

-continued
(A115)
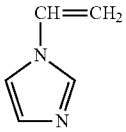
(A116)
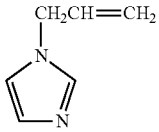
(A117)
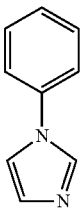
(A118)
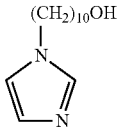
(A119)
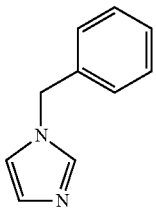
(A120)
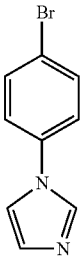
(A121)
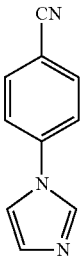
-continued
(A122)
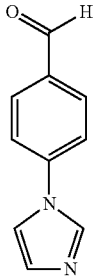
(A123)
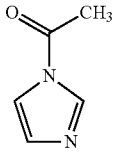
(A124)
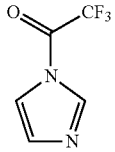
(A125)
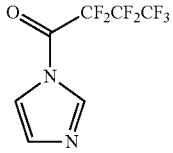
(A126)
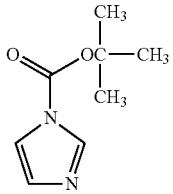
(A127)
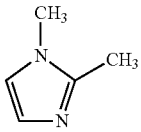
(A128)
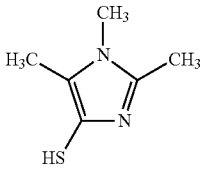
(A129)
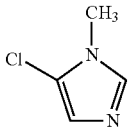
(A130)
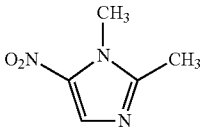

-continued
(A131)
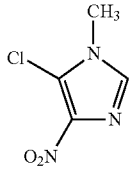
(A132)
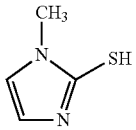
(A133)
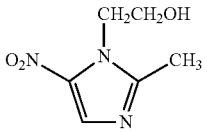
(A134)
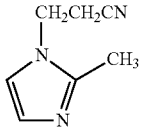
(A135)
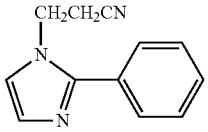
(A136)
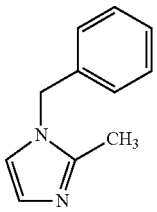
(A137)
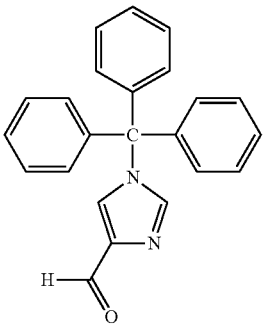
(A138)
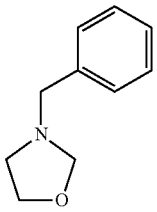
-continued
(A139)
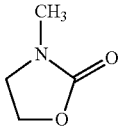
(A140)
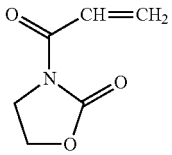
(A141)
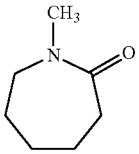
(A142)
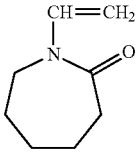
(A143)
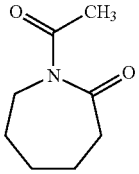
(A144)
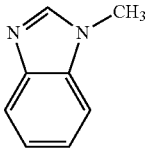
(A145)
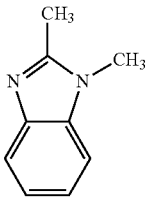
(A146)
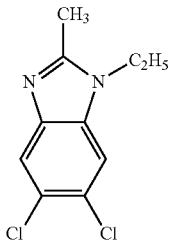

-continued
(A147)
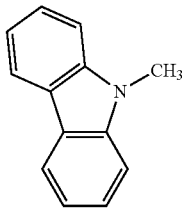
(A148)
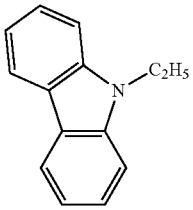
(A149)
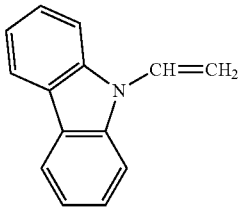
(A150)
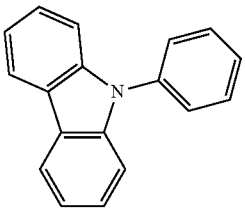
(A151)
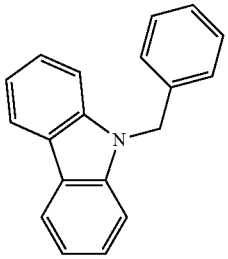
(A152)
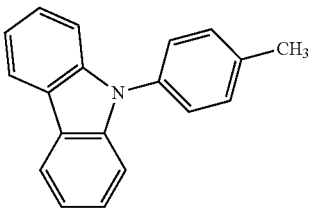
(A153)
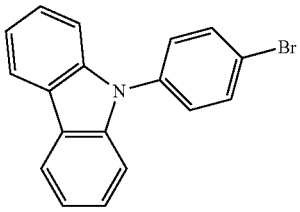
-continued
(A154)
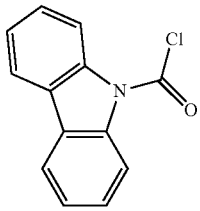
(A155)
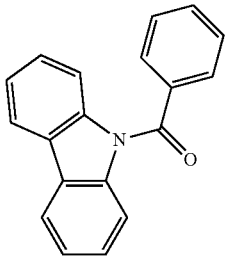
(A156)
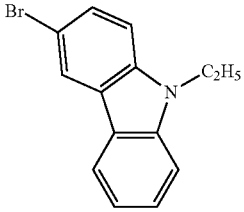
(A157)
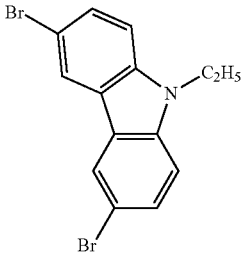
(A158)
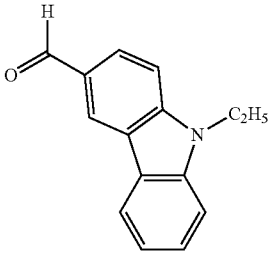
(A159)
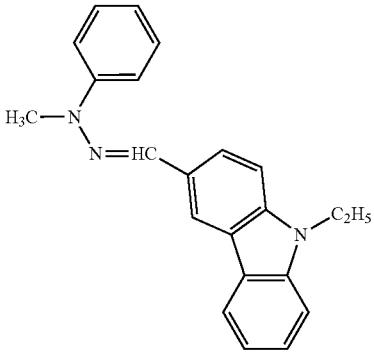

-continued
(A160)
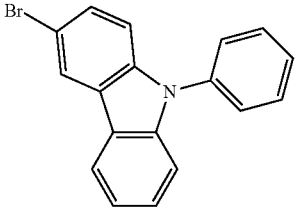
(A161)
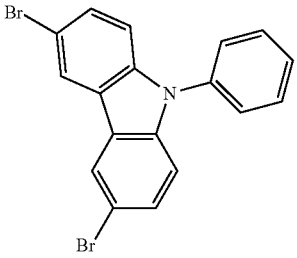
(A162)
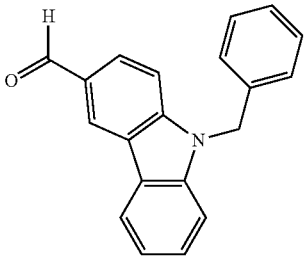
(A163)
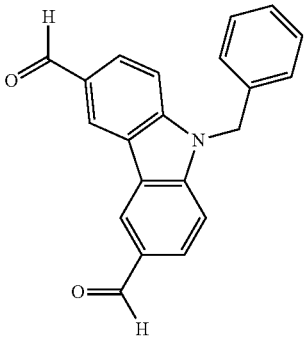
(A164)
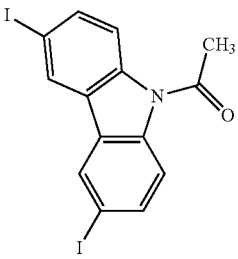
(A165)
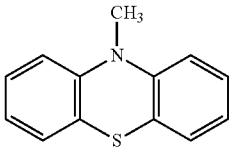
-continued
(A166)
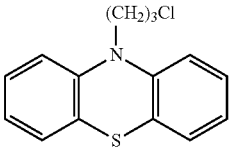
(A167)
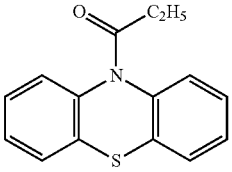
(A168)
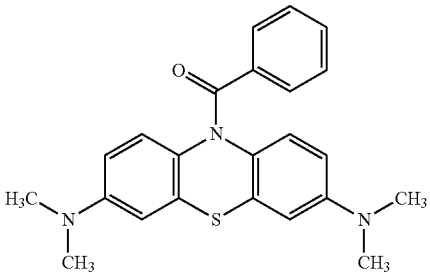
(A169)
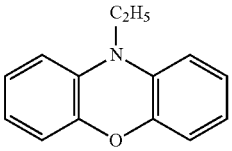
(A170)
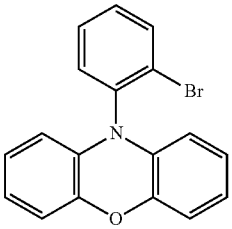
(A171)
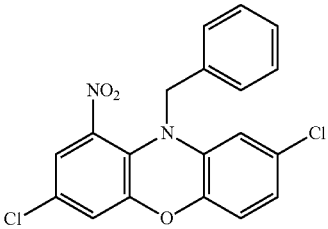
(A172)
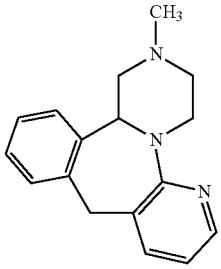
The content of an amide compound represented by the formula (1) in the charge generation layer relative to the gallium phthalocyanine crystal is preferably 0.01% by mass or more and 5% by mass or less.

The gallium phthalocyanine crystal is preferably a gallium phthalocyanine crystal in which an amide compound represented by the formula (1) is contained. In this case, the content of the amide compound represented by the formula (1) and contained within the gallium phthalocyanine crystal relative to the gallium phthalocyanine crystal is preferably 0.01% by mass or more and 3% by mass or less, more preferably 0.01% by mass or more and 1.7% by mass or less.

The mass of the nitrogen-containing heterocyclic compound in the charge generation layer is defined as A. The mass of the amide compound represented by the formula (1) and contained within the gallium phthalocyanine crystal is defined as B. The ratio of A to B is preferably A/B=1/1 or more and 20/1 or less, more preferably A/B=1.4/1 or more and 20/1 or less, particularly preferably A:B=1.4/1 or more and 4/1 or less.

$R^{11}$ in the formula (1) preferably represents a methyl group.

The gallium phthalocyanine crystal contained in an electrophotographic photosensitive member according to the present invention is, for example, gallium phthalocyanine crystal in which the gallium atom of a gallium phthalocyanine molecule has a halogen atom, a hydroxy group, or an alkoxy group as an axial ligand. The phthalocyanine ring may have a substituent such as a halogen atom.

Among gallium phthalocyanine crystals, preferred are hydroxygallium phthalocyanine crystal, bromogallium phthalocyanine crystal, and iodogallium phthalocyanine crystal, which exhibit high sensitivities and are effectively used in the present invention. Of these, more preferred is hydroxygallium phthalocyanine crystal. In a hydroxygallium phthalocyanine crystal, the gallium atom has a hydroxy group as an axial ligand. In a bromogallium phthalocyanine crystal, the gallium atom has a bromine atom as an axial ligand. In an iodogallium phthalocyanine crystal, the gallium atom has an iodine atom as an axial ligand.

Among hydroxygallium phthalocyanine crystal, in particular, preferred is a hydroxygallium phthalocyanine crystal that has a crystal form having a strong peak at 7.4°±0.3° and a strong peak at 28.2°±0.3° in Bragg angle 2θ measured by X-ray diffractometry using CuKα radiation, from the standpoint of high image quality.

The gallium phthalocyanine crystal in which the nitrogen-containing heterocyclic compound is contained means crystal in which the nitrogen-containing heterocyclic compound is incorporated.

The gallium phthalocyanine crystal in which an amide compound represented by the formula (1) is contained means crystal in which an amide compound represented by the formula (1) is incorporated.

A method for producing gallium phthalocyanine crystal containing a nitrogen-containing heterocyclic compound and an amide compound represented by the formula (1) within the crystal will be described.

Gallium phthalocyanine crystal containing a nitrogen-containing heterocyclic compound within the crystal according to the present invention can be obtained by a step in which gallium phthalocyanine obtained by an acid pasting process and a nitrogen-containing heterocyclic compound are mixed with a solvent and subjected to a wet milling treatment to achieve crystal conversion.

This milling treatment is carried out with a milling apparatus such as a sand mill or a ball mill with dispersion media such as glass beads, steel beads, or alumina balls. The amount of the dispersion media used in the milling treatment is preferably 10 to 50 times the amount of gallium phthalocyanine in terms of mass. Examples of the solvent used are as follows: amide solvents such as N,N-dimethylformamide, N,N-dimethylacetamide, compounds represented by the formula (1), N-methylacetamide, and N-methylpropionamide; halogen solvents such as chloroform; ether solvents such as tetrahydrofuran; and sulfoxide solvents such as dimethyl sulfoxide.

Gallium phthalocyanine crystal containing an amide compound represented by the formula (1) within the crystal can be obtained by a step in which gallium phthalocyanine obtained by an acid pasting process and an amide compound represented by the formula (1) are subjected to a wet milling treatment to achieve crystal conversion. The amide compound represented by the formula (1) is N-methylformamide or N-propylformamide.

The amount of the solvent used is preferably 5 to 30 times the amount of gallium phthalocyanine in terms of mass. The amount of the nitrogen-containing heterocyclic compound used is preferably 0.1 to 10 times the amount of gallium phthalocyanine in terms of mass.

Whether or not gallium phthalocyanine crystal according to the present invention contains a nitrogen-containing heterocyclic compound and an amide compound represented by the formula (1) within the crystal is determined by analyzing NMR measurement and thermogravimetric (TG) measurement data of obtained gallium phthalocyanine crystal.

For example, in a case where a solvent that can dissolve a nitrogen-containing heterocyclic compound is used for a milling treatment or a washing step after milling, the resultant gallium phthalocyanine crystal is subjected to NMR measurement. Detection of the presence of the nitrogen-containing heterocyclic compound allows determination that the nitrogen-containing heterocyclic compound is contained within the crystal.

On the other hand, in a case where a nitrogen-containing heterocyclic compound is insoluble in a solvent used in a milling treatment and is also insoluble in a washing solvent after milling, the resultant gallium phthalocyanine crystal is subjected to NMR measurement; and when the nitrogen-containing heterocyclic compound is detected, the determination is made in the following manner.

Gallium phthalocyanine crystal obtained with addition of a nitrogen-containing heterocyclic compound, gallium phthalocyanine crystal obtained without addition of the nitrogen-containing heterocyclic compound, and the nitrogen-containing heterocyclic compound alone are individually subjected to TG measurement. In a case, the TG measurement result of the gallium phthalocyanine crystal obtained with addition of a nitrogen-containing heterocyclic compound intended to be contained within the crystal may be recognized as a simple combination of, in a predetermined ratio, the measurement result of the gallium phthalocyanine crystal obtained without addition of the nitrogen-containing heterocyclic compound and the measurement result of the nitrogen-containing heterocyclic compound. In this case, what is obtained can be recognized as a mixture of gallium phthalocyanine crystal and the nitrogen-containing heterocyclic compound or gallium phthalocyanine crystal to the surfaces of which the nitrogen-containing heterocyclic compound simply adheres.

On the other hand, the TG measurement result of the gallium phthalocyanine crystal obtained with addition of the nitrogen-containing heterocyclic compound may indicate a decrease in the weight at a higher temperature than in the TG measurement result of the nitrogen-containing heterocyclic compound alone, which is intended to be contained within crystal. In this case, the nitrogen-containing heterocyclic compound can be determined to be contained within the gallium phthalocyanine crystal.

Whether or not an amide compound represented by the formula (1) is contained within gallium phthalocyanine crystal can also be determined by a method similar to the above-described method.

Gallium phthalocyanine crystal contained in an electrophotographic photosensitive member according to the present invention is subjected to TG measurement, X-ray diffractometry, and NMR measurement under the following conditions.

[TG Measurement]

Measurement instrument used: TG/DTA simultaneous measurement instrument, manufactured by Seiko Instruments & Electronics Ltd. (trade name: TG/DTA220U)

Atmosphere: under stream of nitrogen (300 ml/min)

Measurement range: 35° C. to 600° C.

Temperature increase rate: 10° C./min

[X-Ray Powder Diffractometry]

Measurement instrument used: X-ray diffractometer RINT-TTRII, manufactured by Rigaku Corporation X-ray tube: Cu Tube voltage: 50 KV Tube current: 300 mA Scanning mode: 2θ/θ scanning Scanning rate: 4.0°/min Sampling intervals: 0.02°

Start angle (2θ): 5.0°

Stop angle (2θ): 40.0°

Attachment: standard sample holder

Filter: not used

Incident monochrometer: used

Counter monochrometer: not used

Divergence slit: open

Vertical divergence limitation slit: 10.00 mm

Scattering slit: open

Receiving slit: open

Flat-plate monochrometer: used

Counter: scintillation counter

[NMR Measurement]

Measurement instrument used: AVANCEIII 500, manufactured by BRUKER

Solvent: bisulfate ($D_2SO_4$)

A charge generation layer contains a nitrogen-containing heterocyclic compound, an amide compound represented by the formula (1), and a gallium phthalocyanine crystal. Alternatively, a charge generation layer contains a gallium phthalocyanine crystal containing an amide compound represented by the formula (1) and a nitrogen-containing heterocyclic compound within the crystal.

A support used in the present invention preferably has conductivity (conductive support). Examples of the material for the support include metals and alloys such as aluminum and stainless steel; and metals, alloys, plastics, and papers having conductive layers. The support may have a shape of a cylinder or a film, for example.

In the present invention, a base coating layer (also referred to as an intermediate layer) that has a barrier function and an adhesion function may be formed between the support and a photosensitive layer.

The material for the base coating layer is a resin such as polyvinyl alcohol, polyethylene oxide, ethylcellulose, methylcellulose, casein, or polyamide. The base coating layer is obtained in the following manner: the resin is dissolved in a solvent to prepare a base coating layer-coating solution; a coating film of the base coating layer-coating solution is formed on the support and the coating film is dried. The base coating layer preferably has a film thickness of 0.3 to 5 μm.

A conductive layer may be formed between the support and the base coating layer for the purpose of covering unevenness and defects of the support and suppressing interference fringes.

The conductive layer can be formed by dispersing conductive particles of carbon black, a metal, a metal oxide, or the like in a binder resin.

The conductive layer preferably has a film thickness of 5 to 40 μm, in particular, preferably 10 to 30 μm.

The charge generation layer can be formed by forming a coating film of a charge generation layer-coating solution in which a nitrogen-containing heterocyclic compound, an amide compound represented by the formula (1), a gallium phthalocyanine crystal, and a binder resin are dispersed in a solvent, and by drying the coating film. The gallium phthalocyanine may be a gallium phthalocyanine crystal containing an amide compound represented by the formula (1) and a nitrogen-containing heterocyclic compound within the crystal.

During the above-described dispersion, a media-type dispersion apparatus such as a sand mill or a ball mill, or a dispersion apparatus such as a liquid-collision-type dispersion apparatus may be used.

The charge generation layer preferably has a film thickness of 0.05 to 1 μm, more preferably 0.05 to 0.2 μm.

In the charge generation layer, the content of gallium phthalocyanine crystal relative to the total mass of the charge generation layer is preferably 30% by mass or more and 90% by mass or less, more preferably 50% by mass or more and 80% by mass or less.

Examples of the binder resin used for the charge generation layer include resins such as polyester resins, acrylic resins, phenoxy resins, polycarbonate resins, polyvinyl butyral resins, polystyrene resins, polyvinyl acetate resins, polysulfone resins, polyarylate resins, vinylidene chloride resins, acrylonitrile copolymers, and polyvinyl benzal resins. Of these, preferred resins in which nitrogen-containing heterocyclic compounds are dispersed are polyvinyl butyral resins and polyvinyl benzal resins.

The charge transport layer can be formed by forming a coating film of a charge transport layer-coating solution containing a charge transport substance and a binder resin, and by drying the coating film.

The charge transport layer preferably has a film thickness of 5 to 40 μm, in particular, preferably 10 to 25 μm.

The content of the charge transport substance relative to the total mass of the charge transport layer is preferably 20% to 80% by mass, in particular, preferably 30% to 60% by mass.

Examples of the charge transport substance include triarylamine compounds, hydrazone compounds, stilbene compounds, pyrazoline compounds, oxazole compounds, thiazole compounds, and triarylmethane compounds. Of these, preferred examples of the charge transport substance are triarylamine compounds.

Examples of the binder resin used for the charge transport layer include resins such as polyester resins, acrylic resins, phenoxy resins, polycarbonate resins, polystyrene resins, polyvinyl acetate resins, polysulfone resins, polyarylate resins, vinylidene chloride resins, and acrylonitrile copolymers. Of these, preferred are polycarbonate resins and polyarylate resins.

Examples of coating methods for individual layers include an immersion coating method (dipping method), a spray coating method, a spinner coating method, a bead coating method, a blade coating method, and a beam coating method.

A protective layer may be formed on the charge transport layer for the purpose of protecting the charge generation layer and the charge transport layer.

The protective layer can be formed by forming a coating film of a protective layer-coating solution obtained by dissolving a resin in an organic solvent, on the charge transport layer, and by drying the coating film. Examples of the resin used for the protective layer include polyvinyl butyral resins, polyester resins, polycarbonate resins (such as polycarbonate Z resins and modified polycarbonate resins), nylon resins, polyimide resins, polyarylate resins, polyurethane resins, styrene-butadiene copolymers, styrene-acrylic acid copolymers, and styrene-acrylonitrile copolymers. Alternatively, the protective layer may be formed by forming a coating film of a protective layer-coating solution on the charge transport layer, and by curing the coating film by heating or with electron beams or ultraviolet rays, for example. The protective layer preferably has a film thickness of 0.05 to 20 μm.

The protective layer may be formed so as to contain conductive particles, an ultraviolet absorber, or lubricant particles such as fluorine-atom-containing fine resin particles, for example. Preferred examples of the conductive particles include metal oxide particles such as tin oxide particles.

FIG. 1 illustrates an example of the schematic configuration of an electrophotographic apparatus including a process cartridge including an electrophotographic photosensitive member.

Reference Sign 1 denotes a cylindrical (drum-shaped) electrophotographic photosensitive member, which is driven so as to be rotated around a shaft 2 in a direction indicated by arrow at a predetermined circumferential speed (process speed).

The surface of the electrophotographic photosensitive member 1 is charged by a charging unit 3 to a predetermined positive or negative potential during rotation. Subsequently, the charged surface of the electrophotographic photosensitive member 1 is irradiated with exposure light 4 emitted by an exposure unit (not shown) to form an electrostatic latent image corresponding to information of an image to be formed. The image exposure light 4 is light that is emitted by the unit for exposure such as slit exposure or laser beam scanning exposure and has been modulated in terms of intensity in accordance with the time series electric digital image signals of information of an image to be formed.

The electrostatic latent image formed on the surface of the electrophotographic photosensitive member 1 is developed with toner contained within a development unit 5 (normal development or reverse development), so that a toner image is formed on the surface of the electrophotographic photosensitive member 1. The toner image formed on the surface of the electrophotographic photosensitive member 1 is transferred by a transfer unit 6 onto a transfer material 7. At this time, a bias power supply (not shown) applies a bias voltage of a polarity opposite to that of the charge of the toner, to the transfer unit 6. In a case where the transfer material 7 is a paper sheet, the transfer material 7 is picked up from a paper supply unit (not shown) and fed into the region between the electrophotographic photosensitive member 1 and the transfer unit 6 in synchronization with rotation of the electrophotographic photosensitive member 1.

The transfer material 7 onto which the toner image has been transferred from the electrophotographic photosensitive member 1, is released from the surface of the electrophotographic photosensitive member 1, subsequently transported to a fixing unit 8, and subjected to a treatment of fixing the toner image. Thus, the transfer material 7 is output as an image-formed material (printed matter or copy) from the electrophotographic apparatus.

The surface of the electrophotographic photosensitive member 1, after transfer of the toner image onto the transfer material 7, is cleaned with a cleaning unit 9 such that attached material such as toner (residual toner after transfer) is removed. In a cleanerless system developed recently, residual toner after transfer can be directly removed with a development unit, for example. The surface of the electrophotographic photosensitive member 1 is destaticized with a pre-exposure light 10 emitted from a pre-exposure unit (not shown) and then repeatedly used for image formation. In a case where the charging unit 3 is a contact charging unit such as a charging roller, the pre-exposure unit is not necessarily provided.

In the present invention, a plurality of components among components including the electrophotographic photosensitive member 1, the charging unit 3, the development unit 5, and the cleaning unit 9 are contained in a container and supported as integrated units to thereby form a process cartridge. This process cartridge can be provided as being detachably mountable on the body of an electrophotographic apparatus. For example, at least one selected from the charging unit 3, the development unit 5, and the cleaning unit 9 and the electrophotographic photosensitive member 1 are supported as integrated units to constitute a cartridge. A guide unit 12 such as rails of the body of the electrophotographic apparatus can be used to provide a process cartridge 11 so as to be detachably mountable on the body of the electrophotographic apparatus.

The exposure light 4, in a case where the electrophotographic apparatus is a copier or a printer, may be light reflected or transmitted by an original document. Alternatively, in a case where an original document is read with a sensor to generate signals, the exposure light 4 may be light emitted by a process carried out in accordance with the signals, such as scanning with a laser beam, driving of an LED array, or driving of a liquid crystal shutter array.

The electrophotographic photosensitive member 1 according to the present invention can also be widely used in electrophotographic application fields encompassing laser beam printers, CRT printers, LED printers, FAXes, liquid crystal printers, and laser platemaking.

EXAMPLES

Hereinafter, the present invention will be described further in detail with reference to specific examples. The term "parts" below means "parts by mass". Note that the present invention is not limited to these examples. The film thicknesses of layers of electrophotographic photosensitive members in Examples and Comparative examples were determined by a method of using an eddy current film thickness measuring instrument (Fischerscope, manufactured by Fischer Instruments K.K.) or by a method of converting mass per unit area with specific gravity.

Synthesis Example 1

In an atmosphere under flow of nitrogen, 5.46 parts of phthalonitrile and 45 parts of α-chloronaphthalene were placed into a reaction chamber, subsequently heated to 30° C., and kept at this temperature. Subsequently, 3.75 parts of gallium trichloride was added at this temperature (30° C.) During this addition, the water content of the mixed solution was 150 ppm. After that, the temperature was increased to 200° C. Subsequently, in an atmosphere under flow of nitrogen, the solution was caused to react at 200° C. for 4.5 hours and then cooled; and when the temperature of the solution was decreased to 150° C., the product was collected by filtration. This substance obtained by filtration was washed by being dispersed in N,N-dimethylformamide at 140° C. for 2 hours and then filtered. The substance obtained by filtration was washed with methanol and then dried to provide 4.65 parts (yield: 71%) of a chlorogallium phthalocyanine pigment.

Subsequently, 4.65 parts of the obtained chlorogallium phthalocyanine pigment was dissolved in 139.5 parts of concentrated sulfuric acid at 10° C., dropped into 620 parts of ice water under stirring to cause reprecipitation, and filtered with a filter press. The obtained wet cake (substance obtained by filtration) was washed by being dispersed in 2% aqueous ammonia and then filtered with a filter press. Subsequently, the obtained wet cake (substance obtained by filtration) was washed by being dispersed in ion-exchanged water and then filtered with a filter press three times. Thus, a hydroxygallium phthalocyanine pigment (hydrous hydroxygallium phthalocyanine pigment) having a solid content of 23% was obtained.

Synthesis Example 2

In an atmosphere under flow of nitrogen, 5.46 parts of phthalonitrile and 45 parts of α-chloronaphthalene were placed into a reaction chamber, subsequently heated to 30° C., and kept at this temperature. Subsequently, 3.75 parts of gallium trichloride was added at this temperature (30° C.) During this addition, the water content of the mixed solution was 150 ppm. After that, the temperature was increased to 200° C. Subsequently, in an atmosphere under flow of nitrogen, the solution was caused to react at 200° C. for 4.5 hours and then cooled; and when the temperature of the solution was decreased to 150° C., the product was collected by filtration. This substance obtained by filtration was washed by being dispersed in N,N-dimethylformamide at 140° C. for 2 hours and then filtered. The substance obtained by filtration was washed with methanol and then dried to provide 4.65 parts (yield: 71%) of a chlorogallium phthalocyanine pigment.

Example 1-1

The hydroxygallium phthalocyanine pigment (6.6 kg) obtained in Synthesis example 1 was dried with a hyper dry dryer (trade name: HD-06R, frequency (output frequency): 2455 MHz±15 MHz, manufactured by Biocon (Japan) ltd.) in the following manner.

The hydroxygallium phthalocyanine pigment obtained in Synthesis example 1, in the state of solid (wet cake having a thickness of 4 cm or less) being taken out of the filter press, was placed on a dedicated circular plastic tray; far-infrared rays were turned off and the inner wall temperature of the dryer was set to 50° C. During application of microwaves, a vacuum pump and a leak valve were adjusted such that the degree of vacuum was in the range of 4.0 to 10.0 kPa.

In a first step, 4.8 kW microwaves were applied to the hydroxygallium phthalocyanine pigment for 50 minutes. Subsequently, the microwaves were temporarily turned off and the leak valve was temporarily closed to provide a high degree of vacuum of 2 kPa or less. At this time, the solid content of the hydroxygallium phthalocyanine pigment was 88%.

In a second step, the leak valve was adjusted such that the degree of vacuum (pressure within the dryer) was in the predetermined range (4.0 to 10.0 kPa). After that, 1.2 kW microwaves were applied to the hydroxygallium phthalocyanine pigment for 5 minutes. The microwaves were temporarily turned off and the leak valve was temporarily closed to provide a high degree of vacuum of 2 kPa or less. This second step was carried out once more (in total, twice). At this time, the solid content of the hydroxygallium phthalocyanine pigment was 98%.

In a third step, microwaves were applied as in the second step except that the power of the microwaves was changed from 1.2 kW in the second step to 0.8 kW. This third step was carried out once more (in total, twice).

In a fourth step, the leak valve was adjusted such that the degree of vacuum (pressure within the dryer) was changed to be again in the predetermined range (4.0 to 10.0 kPa). After that, 0.4 kW microwaves were applied to the hydroxygallium phthalocyanine pigment for 3 minutes. The microwaves were temporarily turned off and the leak valve was temporarily closed to provide a high degree of vacuum of 2 kPa or less. This fourth step was carried out seven times more (in total, eight times).

As a result of the steps for 3 hours in total, 1.52 kg of a hydroxygallium phthalocyanine pigment (crystal) having a water content of 1% or less was obtained.

Figure 2:
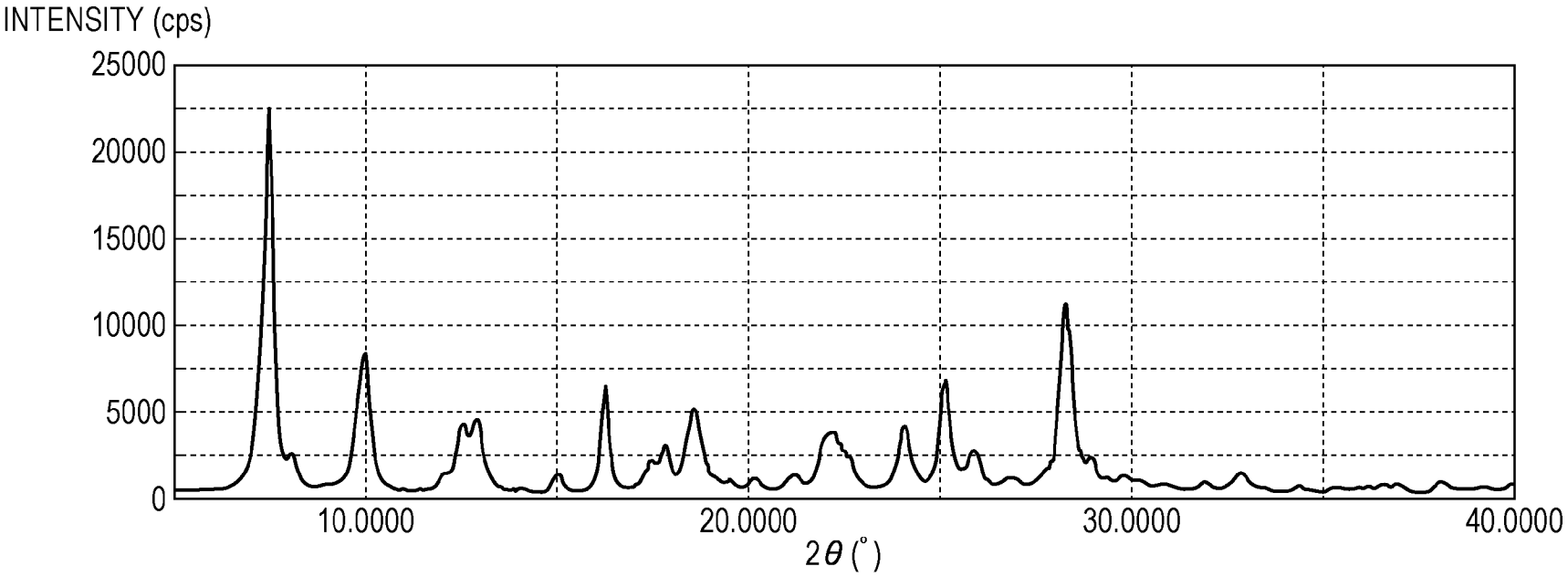
FIG. 2 is an X-ray powder diffraction pattern of a hydroxygallium phthalocyanine crystal obtained in Example 1-1.

Subsequently, 0.5 parts of the obtained hydroxygallium phthalocyanine crystal, 2.7 parts of Compound (A7) (product code: P0196, manufactured by TOKYO CHEMICAL INDUSTRY CO., LTD.), and 9.5 parts of N-methylformamide (product code: F0059, manufactured by TOKYO CHEMICAL INDUSTRY CO., LTD.)

were subjected to a milling treatment together with 15 parts of glass beads having a diameter of 0.8 mm at room temperature (23° C.) for 400 hours with a ball mill. In this treatment, the container used was a standardized bottle (product code: PS-6, manufactured by HAKUYO GLASS Co., Ltd.); and the container was rotated at 60 revolutions per minute. From the dispersion solution, gallium phthalocyanine crystal was taken out with N-methylformamide and filtered, and the filter was sufficiently washed with tetrahydrofuran. The substance obtained by filtration was subjected to vacuum drying to provide 0.45 parts of hydroxygallium phthalocyanine crystal. The X-ray powder diffraction pattern of the obtained crystal is illustrated in FIG. 2.

NMR measurement indicated that the obtained hydroxygallium phthalocyanine crystal contained 0.47% by mass of Compound (A7) and 0.65% by mass of N-methylformamide, which were calculated from the proportions of protons. Since Compound (A7) dissolves in N-methylformamide, the result indicates that Compound (A7) and N-methylformamide were contained within the crystal.

Example 1-2

Figure 3:
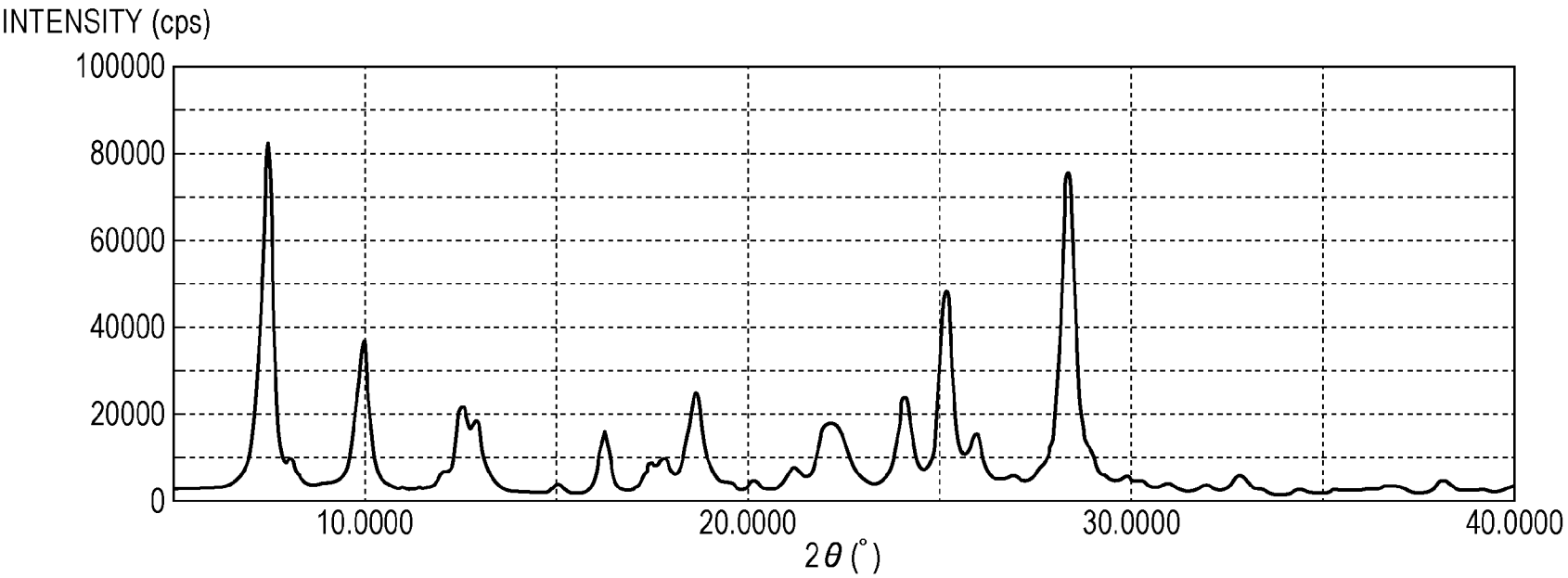
FIG. 3 is an X-ray powder diffraction pattern of a hydroxygallium phthalocyanine crystal obtained in Example 1-2.

Hydroxygallium phthalocyanine crystal in Example 1-2 was obtained as in Example 1-1 except that 2.7 parts of Compound (A7) in Example 1-1 was not used and the milling treatment with the ball mill for 400 hours was changed to a milling treatment with the ball mill for 2000 hours. The X-ray powder diffraction pattern of the obtained crystal is illustrated in FIG. 3.

NMR measurement as in Example 1-1 indicated that the hydroxygallium phthalocyanine crystal contained 0.55% by mass of N-methylformamide.

Example 1-3

Hydroxygallium phthalocyanine crystal in Example 1-3 was obtained as in Example 1-1 except that the amount of Compound (A7) was changed from 2.7 parts in Example 1-1 to 0.7 parts and the milling treatment with the ball mill for 400 hours was changed to a milling treatment with the ball mill for 350 hours. The X-ray powder diffraction pattern of the obtained crystal was similar to that in FIG. 2.

NMR measurement as in Example 1-1 indicated that the hydroxygallium phthalocyanine crystal contained 0.14% by mass of Compound (A7) and 0.71% by mass of N-methylformamide.

Example 1-4

Hydroxygallium phthalocyanine crystal in Example 1-4 was obtained as in Example 1-2 except that the milling treatment with the ball mill for 2000 hours in Example 1-2 was changed to a milling treatment with the ball mill for 100 hours. The X-ray powder diffraction pattern of the obtained crystal was similar to that in FIG. 3.

NMR measurement as in Example 1-1 indicated that the hydroxygallium phthalocyanine crystal contained 2.1% by mass of N-methylformamide.

Example 1-5

Hydroxygallium phthalocyanine crystal in Example 1-5 was obtained as in Example 1-1 except that the amount of Compound (A7) was changed from 2.7 parts in Example 1-1 to 0.5 parts and the milling treatment with the ball mill for 400 hours was changed to a milling treatment with the ball mill for 51 hours. The X-ray powder diffraction pattern of the obtained crystal was similar to that in FIG. 2.

NMR measurement as in Example 1-1 indicated that the hydroxygallium phthalocyanine crystal contained 0.39% by mass of Compound (A7) and 1.86% by mass of N-methylformamide.

Example 1-6

A hydroxygallium phthalocyanine pigment (crystal, 1.52 kg) having a water content of 1% or less was obtained as in Example 1-1.

Figure 4:
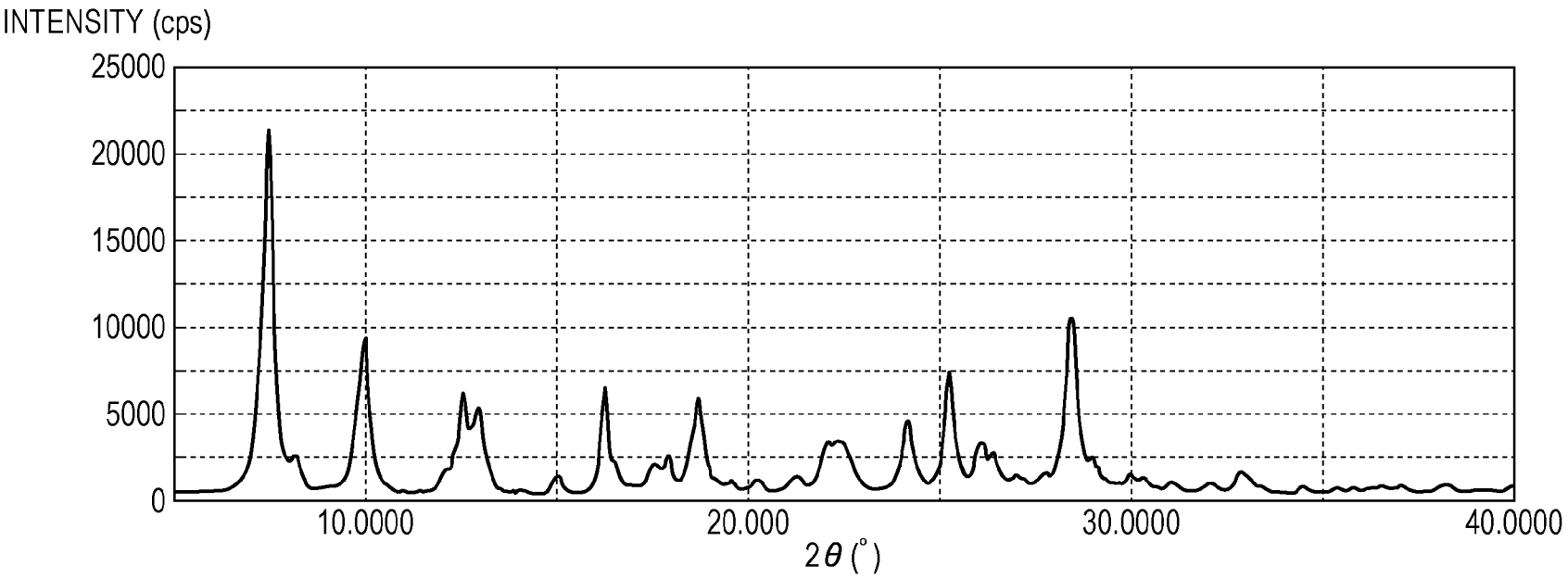
FIG. 4 is an X-ray powder diffraction pattern of a hydroxygallium phthalocyanine crystal obtained in Example 1-6.

Subsequently, 0.5 parts of the obtained hydroxygallium phthalocyanine crystal, 0.5 parts of Compound (A7) (product code: P0196, manufactured by TOKYO CHEMICAL INDUSTRY CO., LTD.), and 9.5 parts of N,N-dimethylformamide (product code: F0059, manufactured by TOKYO CHEMICAL INDUSTRY CO., LTD.)

were subjected to a milling treatment together with 15 parts of glass beads having a diameter of 0.8 mm at room temperature (23° C.) for 51 hours with a ball mill. In this treatment, the container used was a standardized bottle (product code: PS-6, manufactured by HAKUYO GLASS Co., Ltd.); and the container was rotated at 60 revolutions per minute. From the dispersion solution, gallium phthalocyanine crystal was taken out with N,N-dimethylformamide and filtered, and the filter was sufficiently washed with tetrahydrofuran. The substance obtained by filtration was subjected to vacuum drying to provide 0.45 parts of hydroxygallium phthalocyanine crystal. The X-ray powder diffraction pattern of the obtained crystal is illustrated in FIG. 4.

NMR measurement as in Example 1-1 indicated that the hydroxygallium phthalocyanine crystal contained 0.25% by mass of Compound (A7) and 1.74% by mass of N,N-dimethylformamide.

Example 1-7

Hydroxygallium phthalocyanine crystal in Example 1-7 was obtained as in Example 1-1 except that 2.7 parts of Compound (A7) used in Example 1-1 was changed to 2.7 parts of Compound (A16) and the milling treatment with the ball mill for 400 hours was changed to a milling treatment with a Paint Shaker (manufactured by Toyo Seiki Seisakusho, Ltd.) for 40 hours. The X-ray powder diffraction pattern of the obtained crystal was similar to that in FIG. 2.

NMR measurement as in Example 1-1 indicated that the hydroxygallium phthalocyanine crystal contained 0.64% by mass of Compound (A16) and 0.63% by mass of N-methylformamide.

Example 1-8

Figure 5:
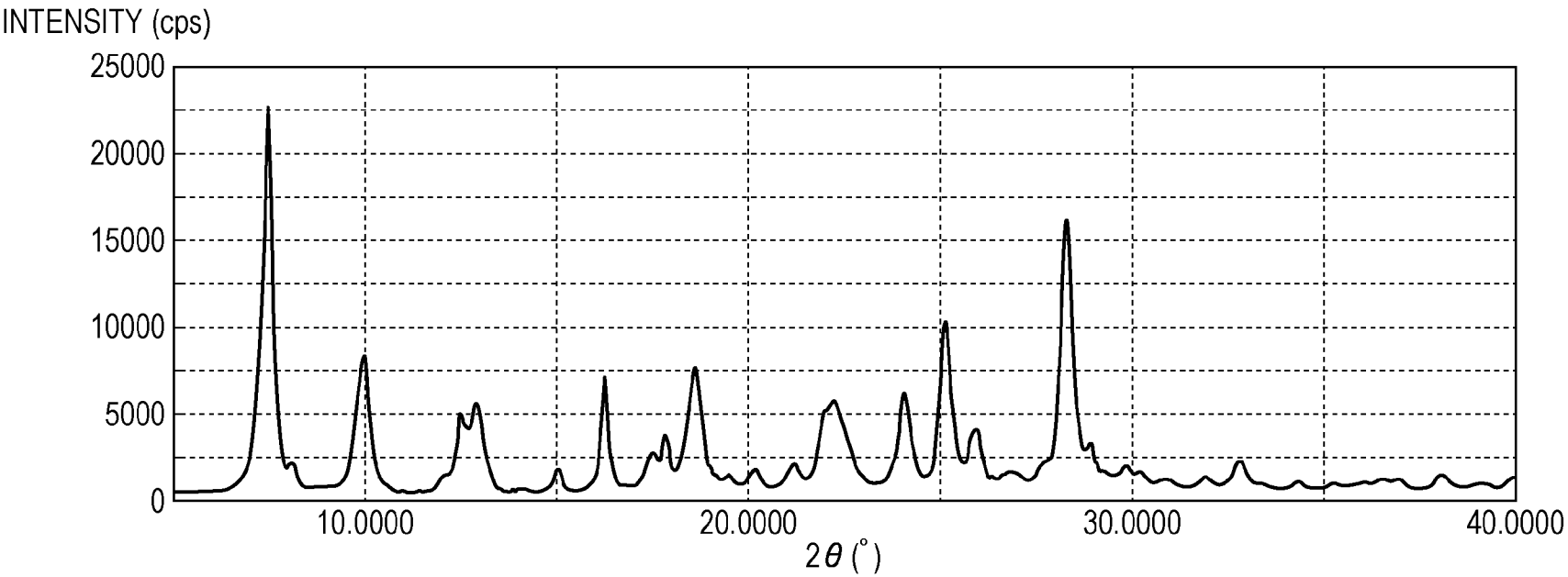
FIG. 5 is an X-ray powder diffraction pattern of a hydroxygallium phthalocyanine crystal obtained in Example 1-8.

Hydroxygallium phthalocyanine crystal in Example 1-8 was obtained as in Example 1-1 except that 2.7 parts of Compound (A7) used in Example 1-1 was changed to 3.0 parts of Compound (A9) and the milling treatment with the ball mill for 400 hours was changed to a milling treatment with the ball mill for 100 hours. The X-ray powder diffraction pattern of the obtained crystal is illustrated in FIG. 5.

NMR measurement as in Example 1-1 indicated that the hydroxygallium phthalocyanine crystal contained 1.59% by mass of Compound (A9) and 1.35% by mass of N-methylformamide.

Example 1-9

Hydroxygallium phthalocyanine crystal in Example 1-9 was obtained as in Example 1-8 except that the amount of Compound (A9) was changed from 3.0 parts in Example 1-8 to 0.5 parts and the milling treatment with the ball mill for 100 hours was changed to a milling treatment with the ball mill for 51 hours. The X-ray powder diffraction pattern of the obtained crystal was similar to that in FIG. 5.

NMR measurement as in Example 1-1 indicated that the hydroxygallium phthalocyanine crystal contained 0.35% by mass of Compound (A9) and 1.89% by mass of N-methylformamide.

Example 1-10

Figure 6:
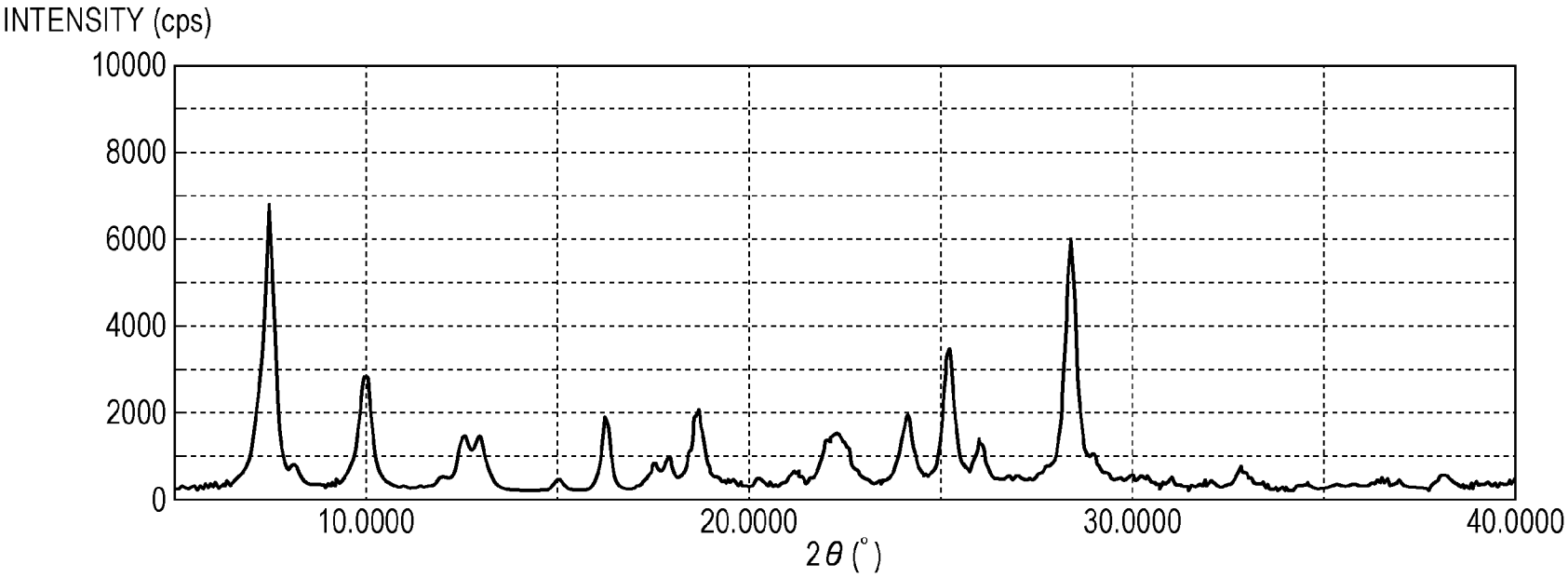
FIG. 6 is an X-ray powder diffraction pattern of a hydroxygallium phthalocyanine crystal obtained in Example 1-10.

Hydroxygallium phthalocyanine crystal in Example 1-10 was obtained as in Example 1-6 except that 0.5 parts of Compound (A7) used in Example 1-6 was changed to 0.5 parts of Compound (A9). The X-ray powder diffraction pattern of the obtained crystal is illustrated in FIG. 6.

NMR measurement as in Example 1-1 indicated that the hydroxygallium phthalocyanine crystal contained 1.35% by mass of Compound (A9) and 1.43% by mass of N,N-dimethylformamide.

Example 1-11

A hydroxygallium phthalocyanine pigment (crystal, 1.52 kg) having a water content of 1% or less was obtained as in Example 1-1.

Subsequently, 0.5 parts of the obtained hydroxygallium phthalocyanine crystal and 9.5 parts of N,N-dimethylformamide (product code: F0059, manufactured by TOKYO CHEMICAL INDUSTRY CO., LTD.)

were subjected to a milling treatment together with 15 parts of glass beads having a diameter of 0.8 mm at room temperature (23° C.) for 100 hours with a ball mill. In this treatment, the container used was a standardized bottle (product code: PS-6, manufactured by HAKUYO GLASS Co., Ltd.); and the container was rotated at 60 revolutions per minute. From the dispersion solution, gallium phthalocyanine crystal was taken out with N,N-dimethylformamide and filtered, and the filter was sufficiently washed with tetrahydrofuran. The substance obtained by filtration was subjected to vacuum drying to provide 0.45 parts of hydroxygallium phthalocyanine crystal. The X-ray powder diffraction pattern of the obtained crystal was similar to that in FIG. 3.

NMR measurement as in Example 1-1 indicated that the hydroxygallium phthalocyanine crystal contained 2.1% by mass of N,N-dimethylformamide.

Example 1-12

Hydroxygallium phthalocyanine crystal in Example 1-12 was obtained as in Example 1-1 except that 2.7 parts of Compound (A7) used in Example 1-1 was changed to 4.0 parts of Compound (A38). The X-ray powder diffraction pattern of the obtained crystal was similar to that in FIG. 2.

NMR measurement as in Example 1-1 indicated that the hydroxygallium phthalocyanine crystal contained 1.28% by mass of Compound (A38) and 0.72% by mass of N-methylformamide.

Example 1-13

Hydroxygallium phthalocyanine crystal in Example 1-13 was obtained as in Example 1-1 except that 2.7 parts of Compound (A7) used in Example 1-1 was changed to 0.1 parts of Compound (A66). The X-ray powder diffraction pattern of the obtained crystal was similar to that in FIG. 2.

NMR measurement as in Example 1-1 indicated that the hydroxygallium phthalocyanine crystal contained 0.06% by mass of Compound (A66) and 0.66% by mass of N-methylformamide.

Example 1-14

Hydroxygallium phthalocyanine crystal in Example 1-14 was obtained as in Example 1-6 except that 0.5 parts of Compound (A7) used in Example 1-6 was changed to 1.0 part of Compound (A75). The X-ray powder diffraction pattern of the obtained crystal was similar to that in FIG. 4.

NMR measurement as in Example 1-1 indicated that the hydroxygallium phthalocyanine crystal contained 0.83% by mass of Compound (A75) and 1.51% by mass of N,N-dimethylformamide.

Example 1-15

Hydroxygallium phthalocyanine crystal in Example 1-15 was obtained as in Example 1-6 except that 0.5 parts of Compound (A7) used in Example 1-6 was changed to 3.0 parts of Compound (A4). The X-ray powder diffraction pattern of the obtained crystal was similar to that in FIG. 4.

NMR measurement as in Example 1-1 indicated that the hydroxygallium phthalocyanine crystal contained 2.22% by mass of Compound (A4) and 1.57% by mass of N,N-dimethylformamide.

Example 1-16

Hydroxygallium phthalocyanine crystal in Example 1-16 was obtained as in Example 1-6 except that 0.5 parts of Compound (A7) used in Example 1-6 was changed to 0.4 parts of Compound (A24). The X-ray powder diffraction pattern of the obtained crystal was similar to that in FIG. 5.

NMR measurement as in Example 1-1 indicated that the hydroxygallium phthalocyanine crystal contained 0.32% by mass of Compound (A24) and 1.49% by mass of N,N-dimethylformamide.

Example 1-17

Hydroxygallium phthalocyanine crystal in Example 1-17 was obtained as in Example 1-2 except that the milling treatment with the ball mill for 2000 hours in Example 1-2 was changed to a milling treatment with the ball mill for 1000 hours. The X-ray powder diffraction pattern of the obtained crystal was similar to that in FIG. 3.

NMR measurement as in Example 1-1 indicated that the hydroxygallium phthalocyanine crystal contained 0.7% by mass of N-methylformamide.

Example 1-18

Hydroxygallium phthalocyanine crystal in Example 1-18 was obtained as in Example 1-2 except that the milling treatment with the ball mill for 2000 hours in Example 1-2 was changed to a milling treatment with the ball mill for 30 hours. The X-ray powder diffraction pattern of the obtained crystal was similar to that in FIG. 3.

NMR measurement as in Example 1-1 indicated that the hydroxygallium phthalocyanine crystal contained 3.3% by mass of N-methylformamide.

Example 1-19

Hydroxygallium phthalocyanine crystal in Example 1-19 was obtained as in Example 1-1 except that 2.7 parts of Compound (A7) used in Example 1-1 was changed to 2.5 parts of Compound (A10). The X-ray powder diffraction pattern of the obtained crystal was similar to that in FIG. 2.

NMR measurement as in Example 1-1 indicated that the hydroxygallium phthalocyanine crystal contained 0.24% by mass of Compound (A10) and 0.68% by mass of N-methylformamide.

Example 1-20

Figure 7:
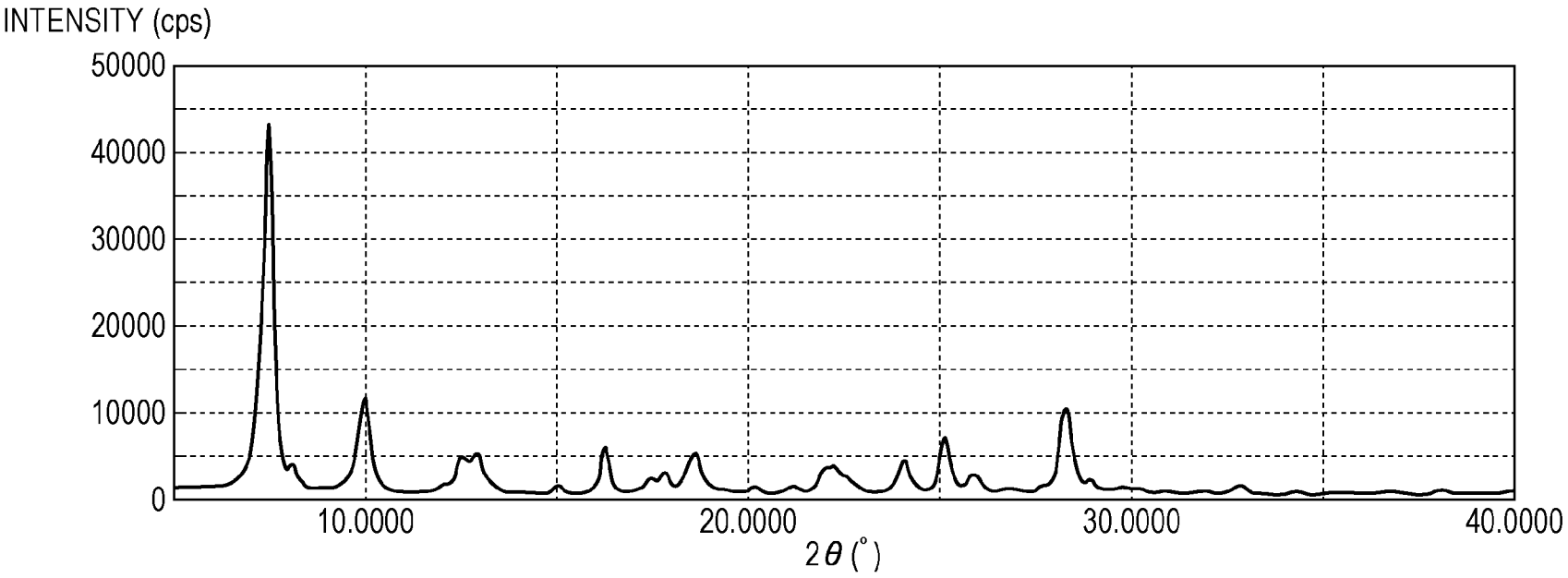
FIG. 7 is an X-ray powder diffraction pattern of a hydroxygallium phthalocyanine crystal obtained in Example 1-20.

Hydroxygallium phthalocyanine crystal in Example 1-20 was obtained as in Example 1-1 except that 2.7 parts of Compound (A7) used in Example 1-1 was changed to 0.5 parts of Compound (A1) and the milling treatment with the ball mill for 400 hours was changed to a milling treatment with the ball mill for 51 hours. The X-ray powder diffraction pattern of the obtained crystal is illustrated in FIG. 7.

NMR measurement as in Example 1-1 indicated that the hydroxygallium phthalocyanine crystal contained 0.13% by mass of Compound (A1) and 1.72% by mass of N-methylformamide.

Example 1-21

Figure 8:
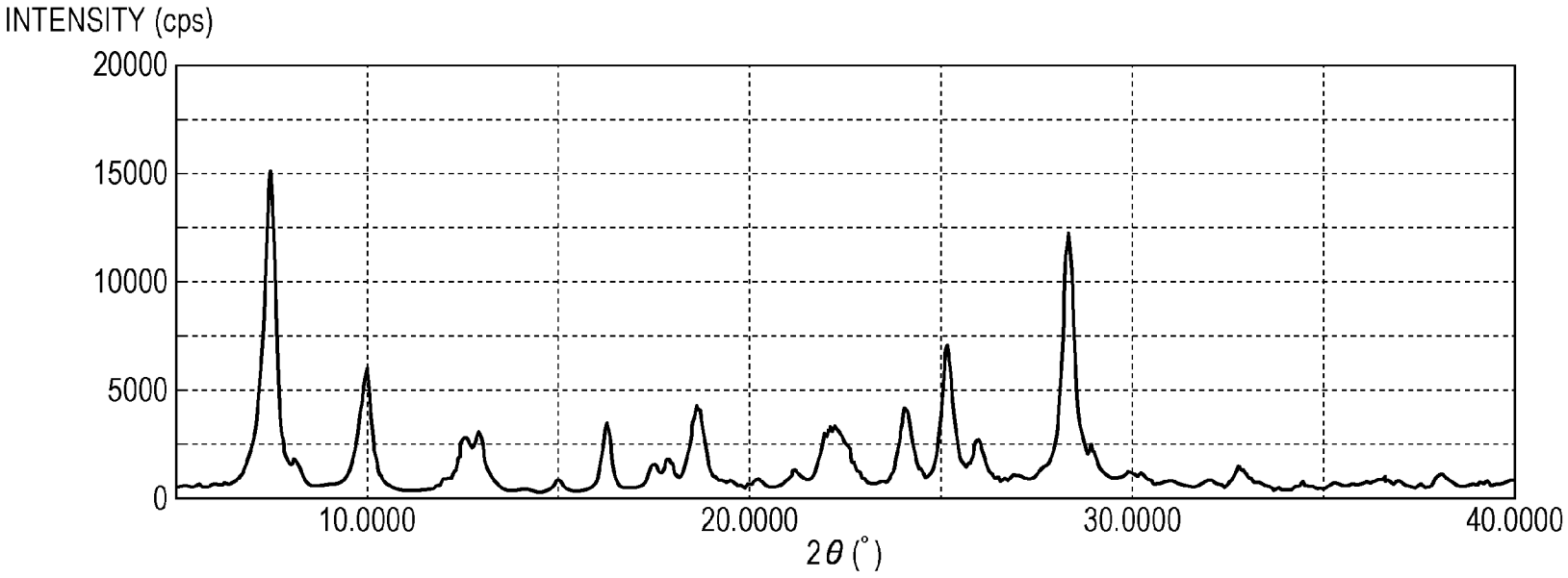
FIG. 8 is an X-ray powder diffraction pattern of a hydroxygallium phthalocyanine crystal obtained in Example 1-21.

Hydroxygallium phthalocyanine crystal in Example 1-21 was obtained as in Example 1-6 except that 0.5 parts of Compound (A7) used in Example 1-6 was changed to 0.5 parts of Compound (A1). The X-ray powder diffraction pattern of the obtained crystal is illustrated in FIG. 8.

NMR measurement as in Example 1-1 indicated that the hydroxygallium phthalocyanine crystal contained 0.36% by mass of Compound (A1) and 1.86% by mass of N,N-dimethylformamide.

Example 1-22

Hydroxygallium phthalocyanine crystal in Example 1-22 was obtained as in Example 1-21 except that the amount of Compound (A1) was changed from 0.5 parts in Example 1-21 to 5.0 parts. The X-ray powder diffraction pattern of the obtained crystal was similar to that in FIG. 8.

NMR measurement as in Example 1-1 indicated that the hydroxygallium phthalocyanine crystal contained 1.29% by mass of Compound (A1) and 1.56% by mass of N,N-dimethylformamide.

Example 1-23

Hydroxygallium phthalocyanine crystal in Example 1-23 was obtained as in Example 1-6 except that 0.5 parts of Compound (A7) used in Example 1-6 was changed to 2.0 parts of Compound (A2). The X-ray powder diffraction pattern of the obtained crystal was similar to that in FIG. 8.

NMR measurement as in Example 1-1 indicated that the hydroxygallium phthalocyanine crystal contained 0.63% by mass of Compound (A1) and 1.77% by mass of N,N-dimethylformamide.

Example 1-24

A hydroxygallium phthalocyanine pigment (crystal, 1.52 kg) having a water content of 1% or less was obtained as in Example 1-1.

Subsequently, 0.5 parts of the obtained hydroxygallium phthalocyanine crystal and 9.5 parts of N-propylformamide together with 15 parts of glass beads having a diameter of 0.8 mm were subjected to a milling treatment at room temperature (23° C.) for 300 hours with a ball mill. In this treatment, the container used was a standardized bottle (product code: PS-6, manufactured by HAKUYO GLASS Co., Ltd.); and the container was rotated at 60 revolutions per minute. From the dispersion solution, gallium phthalocyanine crystal was taken out with N-propylformamide and filtered, and the filter was sufficiently washed with tetrahydrofuran. The substance obtained by filtration was subjected to vacuum drying to provide 0.46 parts of hydroxygallium phthalocyanine crystal. The X-ray powder diffraction pattern of the obtained crystal was similar to that in FIG. 3.

NMR measurement as in Example 1-1 indicated that the hydroxygallium phthalocyanine crystal contained 1.4% by mass of N-propylformamide.

Example 1-25

Hydroxygallium phthalocyanine crystal in Example 1-25 was obtained as in Example 1-24 except that the milling treatment with the ball mill for 300 hours in Example 1-24 was changed to a milling treatment with the ball mill for 1100 hours. The X-ray powder diffraction pattern of the obtained crystal was similar to that in FIG. 3.

NMR measurement as in Example 1-1 indicated that the hydroxygallium phthalocyanine crystal contained 0.69% by mass of N-propylformamide.

Example 1-26

Hydroxygallium phthalocyanine crystal in Example 1-26 was obtained as in Example 1-1 except that 2.7 parts of Compound (A7) used in Example 1-1 was changed to 7.0 parts of Compound (A111) and the milling treatment with the ball mill for 400 hours was changed to a milling treatment with the ball mill for 200 hours. The X-ray powder diffraction pattern of the obtained crystal was similar to that in FIG. 7.

NMR measurement as in Example 1-1 indicated that the hydroxygallium phthalocyanine crystal contained 3.16% by mass of Compound (A111) and 0.85% by mass of N-methylformamide.

Example 1-27

Hydroxygallium phthalocyanine crystal in Example 1-27 was obtained as in Example 1-2 except that the milling treatment with the ball mill for 2000 hours in Example 1-2 was changed to a milling treatment with the ball mill for 35 hours. The X-ray powder diffraction pattern of the obtained crystal was similar to that in FIG. 3.

NMR measurement as in Example 1-1 indicated that the hydroxygallium phthalocyanine crystal contained 3.1% by mass of N-methylformamide.

Comparative Example 1-1

Hydroxygallium phthalocyanine crystal in Comparative Example 1-1 was obtained as in Example 1-6 except that 0.5 parts of Compound (A7) used in Example 1-6 was changed to 1.0 part of a nitrogen-containing heterocyclic compound (product code: M0465, manufactured by TOKYO CHEMICAL INDUSTRY CO., LTD.) represented by the following formula (8).

Formula (8)

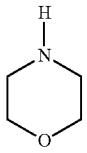

The X-ray powder diffraction pattern of the obtained crystal was similar to that in FIG. 8.

NMR measurement as in Example 1-1 indicated that the hydroxygallium phthalocyanine crystal contained 0.61% by mass of the compound represented by the formula (8) and 1.56% by mass of N,N-dimethylformamide.

Example 2-1

An aluminum cylinder having a diameter of 24 mm and a length of 257 mm was used as a support (cylindrical support).

Subsequently, 60 parts of barium sulfate particles coated with tin oxide (trade name: Passtran PC1, manufactured by MITSUI MINING & SMELTING CO., LTD.), 15 parts of titanium oxide particles (trade name: TITANIX JR, manufactured by Tayca Corporation), 43 parts of a resol-type phenol resin (trade name: PHENOLITE J-325, manufactured by Dainippon Ink and Chemicals, solid content: 70% by mass), 0.015 parts of silicone oil (trade name: SH28PA, manufactured by Toray Silicone Co., Ltd.), 3.6 parts of silicone resin particles (trade name: TOSPEARL 120, manufactured by Toshiba Silicone Co., Ltd.), 50 parts of 2-methoxy-1-propanol, and 50 parts of methanol were charged into a ball mill and subjected to a dispersion treatment for 20 hours to thereby prepare a conductive layer-coating solution. This conductive layer-coating solution was applied to the support by immersion coating. The resultant coating film was heated at 140° C. for 1 hour to cure the coating film. As a result, a conductive layer having a film thickness of 20 μm was formed.

Subsequently, a solution was cooled, the solution being prepared by dissolving (dissolving under heating at 65° C.) 25 parts of N-methoxymethylated nylon 6 (trade name: TORESIN EF-30T, manufactured by Nagase ChemteX Corporation) in 480 parts of a mixed solution of methanol/n-butanol=2/1. After that, the solution was filtered through a membrane filter (trade name: FP-022, pore size: 0.22 μm, manufactured by Sumitomo Electric Industries, Ltd.) to thereby prepare a base coating layer-coating solution. The thus-prepared base coating layer-coating solution was applied to the above-described conductive layer by immersion coating to thereby form a coating film. The coating film was heat-dried in an oven at 100° C. for 10 minutes. As a result, a base coating layer having a film thickness of 0.45 μm was formed.

Subsequently, 20 parts of the hydroxygallium phthalocyanine crystal (charge generation substance) obtained in Example 1-1, 0.10 parts of Example compound (7), 10 parts of polyvinyl butyral (trade name: S-LEC BX-1, manufactured by SEKISUI CHEMICAL CO., LTD.), and 519 parts of cyclohexanone were charged into a sand mill using glass beads having a diameter of 1 mm, subjected to a dispersion treatment for 4 hours, and then mixed with 764 parts of ethyl acetate to thereby prepare a charge generation layer-coating solution. This charge generation layer-coating solution was applied to the base coating layer by immersion coating. The resultant coating film was dried at 100° C. for 10 minutes. As a result, a charge generation layer having a film thickness of 0.18 μm was formed.

The content ratio by mass of Compound (A7) in the charge generation layer to N-methylformamide contained within the hydroxygallium phthalocyanine crystal is 1.49/1.

Subsequently, 70 parts of a triarylamine compound (hole transport substance) represented by the following formula (9), Formula (9)

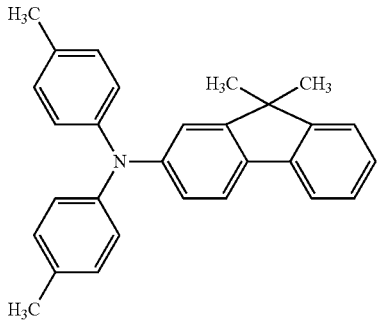

10 parts of a triarylamine compound (hole transport substance) represented by the following formula (10), Formula (10)

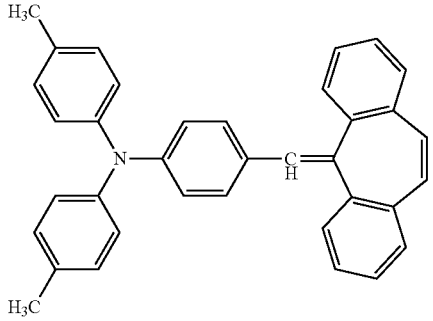

and 100 parts of polycarbonate (trade name: Iupilon Z-200, manufactured by Mitsubishi Engineering-Plastics Corporation) were dissolved in 630 parts of monochlorobenzene to thereby prepare a charge transport layer-coating solution. This charge transport layer-coating solution was applied to the charge generation layer by immersion coating. The resultant coating film was dried at 120° C. for 1 hour. As a result, a charge transport layer (hole transport layer) having a film thickness of 19 μm was formed.

The heat treatments for the coating films of the conductive layer, the base coating layer, the charge generation layer, and the charge transport layer were carried out with an oven set at the individual temperatures. The same applies to other examples below.

Thus, a cylindrical (drum-shaped) electrophotographic photosensitive member in Example 2-1 was produced.

Example 2-2

An electrophotographic photosensitive member in Example 2-2 was produced as in Example 2-1 except that, during preparation of the charge generation layer-coating solution in Example 2-1, 20 parts of the hydroxygallium phthalocyanine crystal obtained in Example 1-1 was changed to 20 parts of the hydroxygallium phthalocyanine crystal obtained in Example 1-2, and the amount of Compound (A7) was changed from 0.10 parts to 0.001 parts.

At this time, the content ratio by mass of Compound (A7) in the charge generation layer to N-methylformamide contained within the hydroxygallium phthalocyanine crystal is 0.01/1.

Example 2-3

An electrophotographic photosensitive member in Example 2-3 was produced as in Example 2-2 except that, during preparation of the charge generation layer-coating solution, the amount of Compound (A7) was changed from 0.001 parts in Example 2-2 to 0.004 parts.

At this time, the content ratio by mass of Example compound (A7) in the charge generation layer to N-methylformamide contained within the hydroxygallium phthalocyanine crystal is 0.04/1.

Example 2-4

An electrophotographic photosensitive member in Example 2-4 was produced as in Example 2-1 except that, during preparation of the charge generation layer-coating solution in Example 2-1, 20 parts of the hydroxygallium phthalocyanine crystal obtained in Example 1-1 was changed to 20 parts of the hydroxygallium phthalocyanine crystal obtained in Example 1-3, and 0.10 parts of Compound (A7) was not used.

At this time, the content ratio by mass of Compound (A7) in the charge generation layer to N-methylformamide contained within the hydroxygallium phthalocyanine crystal is 0.20/1.

Example 2-5

An electrophotographic photosensitive member in Example 2-5 was produced as in Example 2-2 except that, during preparation of the charge generation layer-coating solution, the amount of Compound (A7) was changed from 0.001 parts in Example 2-2 to 0.042 parts.

At this time, the content ratio by mass of Compound (A7) in the charge generation layer to N-methylformamide contained within the hydroxygallium phthalocyanine crystal is 0.38/1.

Example 2-6

An electrophotographic photosensitive member in Example 2-6 was produced as in Example 2-1 except that, during preparation of the charge generation layer-coating solution in Example 2-1, 20 parts of the hydroxygallium phthalocyanine crystal obtained in Example 1-1 was changed to 20 parts of the hydroxygallium phthalocyanine crystal obtained in Example 1-4, and the amount of Compound (A7) was changed from 0.10 parts to 1.0 part.

At this time, the content ratio by mass of Compound (A7) in the charge generation layer to N-methylformamide contained within the hydroxygallium phthalocyanine crystal is 2.38/1.

Example 2-7

An electrophotographic photosensitive member in Example 2-7 was produced as in Example 2-2 except that, during preparation of the charge generation layer-coating solution, the amount of Compound (A7) was changed from 0.001 parts in Example 2-2 to 2 parts.

At this time, the content ratio by mass of Compound (A7) in the charge generation layer to N-methylformamide contained within the hydroxygallium phthalocyanine crystal is 18.2/1.

Example 2-8

An electrophotographic photosensitive member in Example 2-8 was produced as in Example 2-2 except that, during preparation of the charge generation layer-coating solution, the amount of Compound (A7) was changed from 0.001 parts in Example 2-2 to 6 parts.

At this time, the content ratio by mass of Compound (A7) in the charge generation layer to N-methylformamide contained within the hydroxygallium phthalocyanine crystal is 54.6/1.

Example 2-9

An electrophotographic photosensitive member in Example 2-9 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-5.

At this time, the content ratio by mass of Compound (A7) in the charge generation layer to N-methylformamide contained within the hydroxygallium phthalocyanine crystal is 0.21/1.

Example 2-10

An electrophotographic photosensitive member in Example 2-10 was produced as in Example 2-1 except that preparation of the charge generation layer-coating solution in Example 2-1 was changed as described below.

The hydroxygallium phthalocyanine crystal (20 parts) obtained in Example 1-6, 0.1 parts of N-methylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating. The resultant coating film was dried at 100° C. for 10 minutes. As a result, a charge generation layer having a film thickness of 0.18 μm was formed.

The content of N-methylformamide within the hydroxygallium phthalocyanine crystal is 0.

Example 2-11

An electrophotographic photosensitive member in Example 2-11 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-7.

At this time, the content ratio by mass of Compound (A16) in the charge generation layer to N-methylformamide contained within the hydroxygallium phthalocyanine crystal is 1.02/1.

Example 2-12

An electrophotographic photosensitive member in Example 2-12 was produced as in Example 2-10 except that, during preparation of the charge generation layer-coating solution in Example 2-10, 20 parts of the hydroxygallium phthalocyanine crystal obtained in Example 1-6 was changed to 20 parts of the hydroxygallium phthalocyanine crystal obtained in Example 1-8, and the amount of N-methylformamide was changed from 0.1 parts to 0.13 parts.

At this time, the content ratio by mass of Compound (A9) in the charge generation layer to N-methylformamide contained within the hydroxygallium phthalocyanine crystal is 1.18/1.

Example 2-13

An electrophotographic photosensitive member in Example 2-13 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-9.

At this time, the content ratio by mass of Compound (A9) in the charge generation layer to N-methylformamide contained within the hydroxygallium phthalocyanine crystal is 0.19/1.

Example 2-14

An electrophotographic photosensitive member in Example 2-14 was produced as in Example 2-10 except that, during preparation of the charge generation layer-coating solution in Example 2-10, 20 parts of the hydroxygallium phthalocyanine crystal obtained in Example 1-6 was changed to 20 parts of the hydroxygallium phthalocyanine crystal obtained in Example 1-10.

At this time, the content of N-methylformamide within the hydroxygallium phthalocyanine crystal is 0.

Example 2-15

An electrophotographic photosensitive member in Example 2-15 was produced as in Example 2-1 except that preparation of the charge generation layer-coating solution in Example 2-1 was changed as described below.

The hydroxygallium phthalocyanine crystal (20 parts) obtained in Example 1-11, 0.2 parts of Compound (A26), 0.0006 parts of N-methylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating. The resultant coating film was dried at 100° C. for 10 minutes. As a result, a charge generation layer having a film thickness of 0.18 μm was formed.

The content of N-methylformamide within the hydroxygallium phthalocyanine crystal is 0.

Example 2-16

An electrophotographic photosensitive member in Example 2-16 was produced as in Example 2-15 except that, during preparation of the charge generation layer-coating solution, the amount of N-methylformamide was changed from 0.0006 parts in Example 2-15 to 0.006 parts.

At this time, the content of N-methylformamide within the hydroxygallium phthalocyanine crystal is 0.

Example 2-17

An electrophotographic photosensitive member in Example 2-17 was produced as in Example 2-15 except that, during preparation of the charge generation layer-coating solution, the amount of N-methylformamide was changed from 0.0006 parts in Example 2-15 to 0.06 parts.

At this time, the content of N-methylformamide within the hydroxygallium phthalocyanine crystal is 0.

Example 2-18

An electrophotographic photosensitive member in Example 2-18 was produced as in Example 2-15 except that, during preparation of the charge generation layer-coating solution, the amount of N-methylformamide was changed from 0.0006 parts in Example 2-15 to 0.6 parts.

At this time, the content of N-methylformamide within the hydroxygallium phthalocyanine crystal is 0.

Example 2-19

An electrophotographic photosensitive member in Example 2-19 was produced as in Example 2-15 except that, during preparation of the charge generation layer-coating solution, the amount of N-methylformamide was changed from 0.0006 parts in Example 2-15 to 2.0 parts.

At this time, the content of N-methylformamide within the hydroxygallium phthalocyanine crystal is 0.

Example 2-20

An electrophotographic photosensitive member in Example 2-20 was produced as in Example 2-10 except that, during preparation of the charge generation layer-coating solution in Example 2-10, 20 parts of the hydroxygallium phthalocyanine crystal obtained in Example 1-6 was changed to 20 parts of the hydroxygallium phthalocyanine crystal obtained in Example 1-12, and the amount of N-methylformamide was changed from 0.1 parts to 0.056 parts.

At this time, the content ratio by mass of Compound (A38) in the charge generation layer to N-methylformamide contained within the hydroxygallium phthalocyanine crystal is 1.78/1.

Example 2-21

An electrophotographic photosensitive member in Example 2-21 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-13.

At this time, the content ratio by mass of Compound (A66) in the charge generation layer to N-methylformamide contained within the hydroxygallium phthalocyanine crystal is 0.09/1.

Example 2-22

An electrophotographic photosensitive member in Example 2-22 was produced as in Example 2-10 except that, during preparation of the charge generation layer-coating solution in Example 2-10, 20 parts of hydroxygallium phthalocyanine crystal obtained in Example 1-6 was changed to 20 parts of the hydroxygallium phthalocyanine crystal obtained in Example 1-14, and the amount of N-methylformamide was changed from 0.1 parts to 0.2 parts.

At this time, the content of N-methylformamide within the hydroxygallium phthalocyanine crystal is 0.

Example 2-23

An electrophotographic photosensitive member in Example 2-23 was produced as in Example 2-22 except that, during preparation of the charge generation layer-coating solution in Example 2-22, 20 parts of the hydroxygallium phthalocyanine crystal obtained in Example 1-14 was changed to 20 parts of the hydroxygallium phthalocyanine crystal obtained in Example 1-15.

At this time, the content of N-methylformamide within the hydroxygallium phthalocyanine crystal is 0.

Example 2-24

An electrophotographic photosensitive member in Example 2-24 was produced as in Example 2-22 except that, during preparation of the charge generation layer-coating solution in Example 2-22, 20 parts of the hydroxygallium phthalocyanine crystal) obtained in Example 1-14 was changed to 20 parts of the hydroxygallium phthalocyanine crystal obtained in Example 1-16.

At this time, the content of N-methylformamide within the hydroxygallium phthalocyanine crystal is 0.

Example 2-25

An electrophotographic photosensitive member in Example 2-25 was produced as in Example 2-1 except that, during preparation of the charge generation layer-coating solution in Example 2-1, 20 parts of the hydroxygallium phthalocyanine crystal obtained in Example 1-1 was changed to 20 parts of the hydroxygallium phthalocyanine crystal obtained in Example 1-17, and 0.10 parts of Compound (A7) was changed to 0.2 parts of Compound (A51).

At this time, the content ratio by mass of Compound (A51) in the charge generation layer to N-methylformamide contained within the hydroxygallium phthalocyanine crystal is 1.43/1.

Example 2-26

An electrophotographic photosensitive member in Example 2-26 was produced as in Example 2-25 except that, during preparation of the charge generation layer-coating solution in Example 2-25, 20 parts of the hydroxygallium phthalocyanine crystal obtained in Example 1-17 was changed to 20 parts of the hydroxygallium phthalocyanine crystal obtained in Example 1-18.

At this time, the content ratio by mass of Compound (A69) in the charge generation layer to N-methylformamide contained within the hydroxygallium phthalocyanine crystal is 0.30/1.

Example 2-27

An electrophotographic photosensitive member in Example 2-27 was produced as in Example 2-15 except that, during preparation of the charge generation layer-coating solution in Example 2-15, 0.2 parts of Compound (A26) was changed to 0.2 parts of Compound (A76), and the amount of N-methylformamide was changed from 0.0006 parts to 0.2 parts.

At this time, the content of N-methylformamide within the hydroxygallium phthalocyanine crystal is 0.

Example 2-28

An electrophotographic photosensitive member in Example 2-28 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-19.

At this time, the content ratio by mass of Compound (A10) in the charge generation layer to N-methylformamide contained within the hydroxygallium phthalocyanine crystal is 0.35/1.

Example 2-29

An electrophotographic photosensitive member in Example 2-29 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-20.

At this time, the content ratio by mass of Compound (A1) in the charge generation layer to N-methylformamide contained within the hydroxygallium phthalocyanine crystal is 0.08/1.

Example 2-30

An electrophotographic photosensitive member in Example 2-30 was produced as in Example 2-1 except that preparation of the charge generation layer-coating solution in Example 2-1 was changed as described below.

The hydroxygallium phthalocyanine crystal (20 parts) obtained in Example 1-21, 0.2 parts of N-propylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content of N-propylformamide within the hydroxygallium phthalocyanine crystal is 0.

Example 2-31

An electrophotographic photosensitive member in Example 2-31 was produced as in Example 2-30 except that preparation of the charge generation layer-coating solution in Example 2-30 was changed as described below.

The hydroxygallium phthalocyanine crystal (20 parts) obtained in Example 1-22, 0.14 parts of Compound (A1), 0.2 parts of N-propylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content of N-propylformamide within the hydroxygallium phthalocyanine crystal is 0.

Example 2-32

An electrophotographic photosensitive member in Example 2-32 was produced as in Example 2-30 except that, during preparation of the charge generation layer-coating solution in Example 2-30, 20 parts of the hydroxygallium phthalocyanine crystal obtained in Example 1-21 was changed to 20 parts of the hydroxygallium phthalocyanine crystal obtained in Example 1-23.

At this time, the content of N-propylformamide within the hydroxygallium phthalocyanine crystal is 0.

Example 2-33

An electrophotographic photosensitive member in Example 2-33 was produced as in Example 2-31 except that, during preparation of the charge generation layer-coating solution in Example 2-31, 20 parts of the hydroxygallium phthalocyanine crystal obtained in Example 1-22 was changed to 20 parts of the hydroxygallium phthalocyanine crystal obtained in Example 1-24, and 0.14 parts of Compound (A1) was changed to 0.6 parts of Compound (A54).

At this time, the content ratio by mass of Compound (A54) in the charge generation layer to N-propylformamide contained within the hydroxygallium phthalocyanine crystal is 2.14/1.

Example 2-34

An electrophotographic photosensitive member in Example 2-34 was produced as in Example 2-1 except that preparation of the charge generation layer-coating solution in Example 2-1 was changed as described below.

The chlorogallium phthalocyanine crystal (20 parts) obtained in Synthesis example 2, 1 part of Compound (A57), 0.2 parts of N-propylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content of N-propylformamide within the chlorogallium phthalocyanine crystal is 0.

Example 2-35

An electrophotographic photosensitive member in Example 2-35 was produced as in Example 2-34 except that, during preparation of the charge generation layer-coating solution in Example 2-34, 1 part of Compound (A57) was changed to 0.15 parts of Compound (A7) and 0.2 parts of N-propylformamide was changed to 0.074 parts of N-methylformamide.

At this time, the content of N-methylformamide within the chlorogallium phthalocyanine crystal is 0.

Example 2-36

An electrophotographic photosensitive member in Example 2-36 was produced as in Example 2-2 except that, during preparation of the charge generation layer-coating solution in Example 2-2, 0.001 parts of Compound (A7) was changed to 0.2 parts of Compound (A85).

At this time, the content ratio by mass of Compound (A85) in the charge generation layer to N-methylformamide contained within the hydroxygallium phthalocyanine crystal is 1.82/1.

Example 2-37

An electrophotographic photosensitive member in Example 2-37 was produced as in Example 2-33 except that preparation of the charge generation layer-coating solution in Example 2-33 was changed as described below.

The hydroxygallium phthalocyanine crystal (20 parts) obtained in Example 1-24, 0.2 parts of Compound (A163), 1.72 parts of N-propylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content ratio by mass of Compound (A163) in the charge generation layer to N-propylformamide contained within the hydroxygallium phthalocyanine crystal is 0.71/1.

Example 2-38

An electrophotographic photosensitive member in Example 2-38 was produced as in Example 2-37 except that, during preparation of the charge generation layer-coating solution in Example 2-37, 0.2 parts of Compound (A163) was changed to 0.2 parts of Compound (A100).

At this time, the content ratio by mass of Compound (A100) in the charge generation layer to N-propylformamide contained within the hydroxygallium phthalocyanine crystal is 0.71/1.

Example 2-39

An electrophotographic photosensitive member in Example 2-39 was produced as in Example 2-33 except that, during preparation of the charge generation layer-coating solution in Example 2-33, 20 parts of the hydroxygallium phthalocyanine crystal obtained in Example 1-24 was changed to 20 parts of the hydroxygallium phthalocyanine crystal obtained in Example 1-25, and 0.6 parts of Compound (A54) was changed to 0.2 parts of Compound (A5).

At this time, the content ratio by mass of Example compound (5) in the charge generation layer to N-propylformamide contained within the hydroxygallium phthalocyanine crystal is 1.45/1.

Example 2-40

An electrophotographic photosensitive member in Example 2-40 was produced as in Example 2-30 except that preparation of the charge generation layer-coating solution in Example 2-30 was changed as described below.

The hydroxygallium phthalocyanine crystal (20 parts) obtained in Example 1-11, 0.2 parts of Compound (A53), 2.0 parts of N-propylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content of N-propylformamide within the hydroxygallium phthalocyanine crystal is 0.

Example 2-41

An electrophotographic photosensitive member in Example 2-41 was produced as in Example 2-4 except that, during preparation of the charge generation layer-coating solution in Example 2-4, 20 parts of the hydroxygallium phthalocyanine crystal obtained in Example 1-3 was changed to 20 parts of the hydroxygallium phthalocyanine crystal obtained in Example 1-26.

At this time, the content ratio by mass of Compound (A111) in the charge generation layer to N-methylformamide contained within the hydroxygallium phthalocyanine crystal is 3.72/1.

Example 2-42

An electrophotographic photosensitive member in Example 2-42 was produced as in Example 2-40 except that, during preparation of the charge generation layer-coating solution in Example 2-40, 0.2 parts of Compound (A53) was changed to 0.2 parts of Compound (A131), and the amount of N-propylformamide was changed from 2.0 parts to 0.2 parts.

At this time, the content of N-propylformamide within the hydroxygallium phthalocyanine crystal is 0.

Example 2-43

An electrophotographic photosensitive member in Example 2-43 was produced as in Example 2-25 except that, during preparation of the charge generation layer-coating solution in Example 2-25, 20 parts of the hydroxygallium phthalocyanine crystal obtained in Example 1-17 was changed to 20 parts of the hydroxygallium phthalocyanine crystal obtained in Example 1-27.

At this time, the content ratio by mass of Compound (A141) in the charge generation layer to N-methylformamide contained within the hydroxygallium phthalocyanine crystal is 0.32/1.

Example 2-44

An electrophotographic photosensitive member in Example 2-44 was produced as in Example 2-40 except that, during preparation of the charge generation layer-coating solution in Example 2-40, 0.2 parts of Compound (A53) was changed to 0.2 parts of Compound (A138), and the amount of N-propylformamide was changed from 2.0 parts to 0.2 parts.

At this time, the content of N-propylformamide within the hydroxygallium phthalocyanine crystal is 0.

Comparative Example 2-1

An electrophotographic photosensitive member in Comparative Example 2-1 was produced as in Example 2-1 except that preparation of the charge generation layer-coating solution in Example 2-1 was changed as described below.

The hydroxygallium phthalocyanine crystal (20 parts) obtained in Example 1-11, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content of the nitrogen-containing heterocyclic compound in the charge generation layer and the content of the amide compound represented by the formula (1) in the charge generation layer are both 0.

Comparative Example 2-2

An electrophotographic photosensitive member in Comparative Example 2-2 was produced as in Example 2-15 except that 0.0006 parts of N-methylformamide used for preparation of the charge generation layer-coating solution in Example 2-15 was not used. At this time, the content of the amide compound represented by the formula (1) in the charge generation layer is 0.

Comparative Example 2-3

An electrophotographic photosensitive member in Comparative Example 2-3 was produced as in Example 2-1 except that preparation of the charge generation layer-coating solution in Example 2-1 was changed as described below.

The hydroxygallium phthalocyanine crystal (20 parts) obtained in Comparative example 1-1, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating. The resultant coating film was dried at 100° C. for 10 minutes. As a result, a charge generation layer having a film thickness of 0.18 μm was formed.

The content of the nitrogen-containing heterocyclic compound in the charge generation layer and the content of the amide compound represented by the formula (1) in the charge generation layer are both 0.

Comparative Example 2-4

An electrophotographic photosensitive member in Comparative Example 2-4 was produced as in Example 2-1 except that preparation of the charge generation layer-coating solution in Example 2-1 was changed as described below.

The hydroxygallium phthalocyanine crystal (20 parts) obtained in Comparative example 1-1, 0.5 parts of N-methylformamide, 10 parts of polyvinyl butyral (trade name: S-LEC BX-1), and 519 parts of cyclohexanone were charged into a sand mill using glass beads having a diameter of 1 mm and subjected to a dispersion treatment for 4 hours. After that, 764 parts of ethyl acetate was added to thereby prepare a charge generation layer-coating solution. This charge generation layer-coating solution was applied to the base coating layer by immersion coating to thereby form a coating film. The coating film was dried at 100° C. for 10 minutes. As a result, a charge generation layer having a film thickness of 0.18 μm was formed.

The content of the nitrogen-containing heterocyclic compound in the charge generation layer and the content of N-methylformamide within the hydroxygallium phthalocyanine crystal are both 0.

Comparative Example 2-5

An electrophotographic photosensitive member in Comparative Example 2-5 was produced as in Example 2-1 except that preparation of the charge generation layer-coating solution in Example 2-1 was changed as described below.

A bisazo pigment (20 parts) represented by a formula (11) below, 0.2 parts of Compound (A7), 0.1 parts of N-methylformamide, 8 parts of polyvinyl butyral (trade name: S-LEC BX-1), and 380 parts of cyclohexanone were charged into a sand mill using glass beads having a diameter of 0.8 mm and subjected to a dispersion treatment for 20 hours. After that, 640 parts of ethyl acetate was added to thereby prepare a charge generation layer-coating solution. This charge generation layer-coating solution was applied to the base coating layer by immersion coating to thereby form a coating film. The coating film was dried at 80° C. for 10 minutes. As a result, a charge generation layer having a film thickness of 0.28 μm was formed.

Evaluations of Examples 2-1 to 2-44 and Comparative Examples 2-1 to 2-5

The electrophotographic photosensitive members produced in Examples 2-1 to 2-44 and Comparative examples 2-1 to 2-5 were subjected to image evaluations.

The electrophotographic apparatus used for the evaluations was a laser beam printer LaserJet 4700 (manufactured by Hewlett-Packard Company) that was modified so as to allow evaluations in terms of black spots, fogging, and density unevenness. This printer was modified such that the dark area potential was set to −700 V.

Each of the produced electrophotographic photosensitive members was left for 24 hours in a high temperature and high humidity environment at a temperature of 32.5° C. and a humidity of 80% RH and subsequently attached to a cyan process cartridge for the laser printer. This cyan process cartridge was mounted on a cyan process cartridge station within the laser printer. The laser beam printer was set so as to operate without process cartridges for other colors being mounted on the body of the laser beam printer. In the same environment, images for evaluations were printed.

The evaluation in terms of black spots and fogging was performed in the following manner: a solid white image was printed on glossy paper sheets and the printed images were visually inspected for defects and evaluated into A to F ranks. Rank A corresponds to printed images in which no black spots are observed in the images. Rank B, Rank C, Rank D, and Rank E respectively correspond to images having 1 to 2, 3 to 4, 5 to 10, and 11 to 20 black spots having a diameter (ϕ) of 0.3 mm or less in a region corresponding to one rotation of the electrophotographic photosensitive member. Similarly, Rank F corresponds to images having 21 or more black spots having a diameter (ϕ) of 0.3 mm or less.

Of these, E and F are determined as levels corresponding to cases where advantages according to the present invention are not sufficiently provided.

The evaluation in terms of density unevenness was performed by printing a halftone image having a dot density of one dot and one space and the printed images were subjected to a sensory test.

Evaluation results are described in Table 1.

TABLE 1

| | Evaluation in terms of black spots and fogging | Evaluation in terms of density unevenness |
|---|---|---|
| Example 2-1 | A | Excellent |
| Example 2-2 | C | Good |
| Example 2-3 | C | Good |

Formula (11)

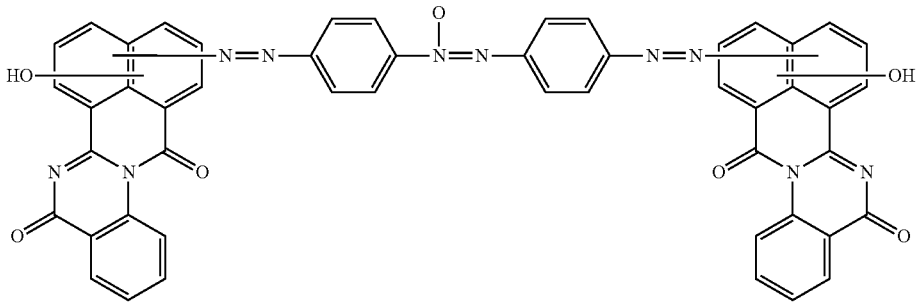

TABLE 1-continued

| | Evaluation in terms of black spots and fogging | Evaluation in terms of density unevenness |
|---|---|---|
| Example 2-4 | A | Good |
| Example 2-5 | B | Good |
| Example 2-6 | B | Excellent |
| Example 2-7 | B | Excellent |
| Example 2-8 | C | Good |
| Example 2-9 | B | Good |
| Example 2-10 | B | Good |
| Example 2-11 | A | Good |
| Example 2-12 | A | Good |
| Example 2-13 | B | Good |
| Example 2-14 | B | Good |
| Example 2-15 | D | Good |
| Example 2-16 | D | Good |
| Example 2-17 | D | Good |
| Example 2-18 | D | Good |
| Example 2-19 | D | Good |
| Example 2-20 | A | Excellent |
| Example 2-21 | A | Good |
| Example 2-22 | B | Good |
| Example 2-23 | C | Good |
| Example 2-24 | C | Good |
| Example 2-25 | C | Excellent |
| Example 2-26 | C | Good |
| Example 2-27 | D | Good |
| Example 2-28 | B | Good |
| Example 2-29 | B | Good |
| Example 2-30 | C | Good |
| Example 2-31 | C | Good |
| Example 2-32 | C | Good |
| Example 2-33 | D | Good |
| Example 2-34 | D | Good |
| Example 2-35 | D | Good |
| Example 2-36 | C | Excellent |
| Example 2-37 | D | Good |
| Example 2-38 | D | Good |
| Example 2-39 | D | Good |
| Example 2-40 | D | Good |
| Example 2-41 | A | Excellent |
| Example 2-42 | D | Good |
| Example 2-43 | D | Good |
| Example 2-44 | D | Good |
| Comparative example 2-1 | F | Unevenness in density |
| Comparative example 2-2 | E | Unevenness in density |
| Comparative example 2-3 | E | Unevenness in density |
| Comparative example 2-4 | E | Good |
| Comparative example 2-5 | F | Unevenness in density |

The present invention can provide an electrophotographic photosensitive member that can provide images in which black spots and fogging are suppressed and density unevenness due to coating unevenness in the charge generation layer is suppressed. The present invention can also provide a process cartridge and an electrophotographic apparatus that include the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2014/065727, filed Jun. 13, 2014, which is hereby incorporated by reference herein in its entirety.

The invention claimed is:

1. An electrophotographic photosensitive member comprising a support, a charge generation layer formed on the support, and a charge transport layer formed on the charge generation layer, wherein the charge generation layer comprises a gallium phthalocyanine crystal, a nitrogen-containing heterocyclic compound contained in the gallium phthalocyanine crystal, and an amide compound represented by a formula (1) below, (1)

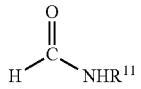

in the formula (1), $R^{11}$ represents a methyl group or a propyl group, a nitrogen atom in a heterocyclic ring of the nitrogen-containing heterocyclic compound has a substituent, the substituent of the nitrogen atom having a substituent is a substituted or unsubstituted acyl group, —(C═O)—O—$R^1$, a substituted or unsubstituted alkyl group, a substituted or unsubstituted alkenyl group, a substituted or unsubstituted aryl group, or a substituted or unsubstituted heterocyclic group, where a substituent of the substituted acyl group is a group described in (i) below; and $R^1$ represents a group described in (ii) below, (i) a substituted or unsubstituted alkyl group, a substituted or unsubstituted alkenyl group, a substituted or unsubstituted aryl group, or a substituted or unsubstituted heterocyclic group where, in this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group, (ii) a substituted or unsubstituted alkyl group, a substituted or unsubstituted alkenyl group, a substituted or unsubstituted aryl group, or a substituted or unsubstituted heterocyclic group where, in this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group, wherein the nitrogen-containing heterocyclic compound is a compound represented by a formula (2) below, (2)

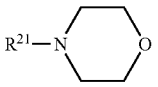

in the formula (2), $R^{21}$ represents a substituted or unsubstituted acyl group, —(C═O)—O—$R^2$, a substituted or unsubstituted alkyl group, a substituted or unsubstituted alkenyl group, a substituted or unsubstituted aryl group, or a substituted or unsubstituted heterocyclic group, a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group, and a substituent of the substituted acyl group is a group described in (i) below, and $R^2$ represents a group described in (ii) below, (i) a substituted or unsubstituted alkyl group, a substituted or unsubstituted alkenyl group, a substituted or unsubstituted aryl group, or a substituted or unsubstituted heterocyclic group where, in this (i), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group, (ii) a substituted or unsubstituted alkyl group, a substituted or unsubstituted alkenyl group, a substituted or unsubstituted aryl group, or a substituted or unsubstituted heterocyclic group where, in this (ii), a substituent of the substituted alkyl group, a substituent of the substituted alkenyl group, a substituent of the substituted aryl group, and a substituent of the substituted heterocyclic group are each a halogen atom, a cyano group, a nitro group, a hydroxy group, a formyl group, an alkyl group, an alkenyl group, an alkoxy group, or an aryl group.

2. The electrophotographic photosensitive member according to claim 1, wherein, in the formula (2), $R^{21}$ represents a methyl group, an ethyl group, or a phenyl group.

3. The electrophotographic photosensitive member according to claim 1, wherein a content of the nitrogen-containing heterocyclic compound in the charge generation layer relative to the gallium phthalocyanine crystal is 0.01% by mass or more and 20% by mass or less.

4. The electrophotographic photosensitive member according to claim 1, wherein a content of the nitrogen-containing heterocyclic compound within the gallium phthalocyanine crystal relative to the gallium phthalocyanine crystal is 0.01% by mass or more and 2% by mass or less.

5. The electrophotographic photosensitive member according to claim 1, wherein the gallium phthalocyanine crystal is a gallium phthalocyanine crystal in which the amide compound represented by the formula (1) is contained.

6. The electrophotographic photosensitive member according to claim 5, wherein a content of the amide compound represented by the formula (1) within the gallium phthalocyanine crystal relative to the gallium phthalocyanine crystal is 0.01% by mass or more and 3% by mass or less.

7. The electrophotographic photosensitive member according to claim 5, wherein a content ratio by mass of the nitrogen-containing heterocyclic compound in the charge generation layer to the amide compound represented by the formula (1) and contained within the gallium phthalocyanine crystal is 1.4/1 or more and 20/1 or less.

8. The electrophotographic photosensitive member according to claim 1, wherein $R^{11}$ in the formula (1) represents a methyl group.

9. The electrophotographic photosensitive member according to claim 1, wherein the gallium phthalocyanine crystal is a hydroxygallium phthalocyanine crystal that has a peak at 7.4°±0.3° and a peak at 28.2°±0.3° in Bragg angle 2θ measured by X-ray diffractometry using CuKα radiation.

10. A process cartridge supporting, as integrated units, the electrophotographic photosensitive member according to claim 1, and at least one unit selected from the group consisting of a charging unit, a development unit, and a cleaning unit, wherein the process cartridge is detachably mountable on a body of an electrophotographic apparatus.

11. An electrophotographic apparatus comprising the electrophotographic photosensitive member according to claim 1, a charging unit, an exposure unit, a development unit, and a transfer unit.

* * * * *